US007805314B2

(12) United States Patent
Sung et al.

(10) Patent No.: US 7,805,314 B2
(45) Date of Patent: Sep. 28, 2010

(54) METHOD AND APPARATUS TO QUANTIZE/DEQUANTIZE FREQUENCY AMPLITUDE DATA AND METHOD AND APPARATUS TO AUDIO ENCODE/DECODE USING THE METHOD AND APPARATUS TO QUANTIZE/DEQUANTIZE FREQUENCY AMPLITUDE DATA

(75) Inventors: Hosang Sung, Yongin-si (KR); Sangwook Kim, Seoul (KR); Rakesh Taori, Suwon-si (KR); Kangeun Lee, Gangneung-si (KR); Shihwa Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1044 days.

(21) Appl. No.: 11/471,635

(22) Filed: Jun. 21, 2006

(65) Prior Publication Data

US 2007/0016417 A1 Jan. 18, 2007

(30) Foreign Application Priority Data

Jul. 13, 2005 (KR) ..... 10-2005-0063304
Feb. 18, 2006 (KR) ..... 10-2006-0015940

(51) Int. Cl.
*G10L 19/00* (2006.01)
*G10L 19/02* (2006.01)

(52) U.S. Cl. ..... 704/501; 704/201; 704/205

(58) Field of Classification Search ..... None
See application file for complete search history.

(56) References Cited

U.S. PATENT DOCUMENTS 4,975,956 A * 12/1990 Liu et al. ..... 704/219
5,848,387 A * 12/1998 Nishiguchi et al. ..... 704/214
6,377,914 B1 * 4/2002 Yeldener ..... 704/205
6,493,664 B1 * 12/2002 Udaya Bhaskar et al. ... 704/222

OTHER PUBLICATIONS

Gaoutherot et al., "LPC Residual Phase Investigation", First European Conference on Speech Communication and Technology, Eurospeech, pp. 2035-2038, 1989.*

Mizui et al., "A Robust and Data Compressed Coding Scheme Using Interpolation Error", IEEE International Conference on Communications, ICC, vol. 3, pp. 1883-1887, 1986.*

(Continued)

*Primary Examiner*—Brian L Albertalli
(74) *Attorney, Agent, or Firm*—Stanzione & Kim, LLP

(57) ABSTRACT

A method and apparatus to quantize/dequantize frequency amplitude data and a method and apparatus to audio encode/decode using the method and apparatus to quantize/dequantize the frequency amplitude data. The method includes calculating and quantizing power of frequency amplitudes for each of a plurality of bands constituting an audio frame, normalizing frequency amplitude data for each of the bands using the quantized power, and quantizing a first one of even-numbered or odd-numbered data among the normalized frequency amplitude data. The method may further include interpolating frequency amplitude data that corresponds to a second one of the even-numbered or odd-numbered frequency amplitude that is not quantized from among the normalized frequency amplitude data using the quantized first one of the even-numbered or odd-numbered data, and quantizing an interpolation error corresponding to a difference between the second frequency amplitude data that is not quantized and the interpolated frequency amplitude data.

22 Claims, 13 Drawing Sheets

OTHER PUBLICATIONS

Jayant et al., "Effects of Packet Losses in Waveform Coded Speech and Improvements Due to an Odd-Even Sample-Interpolation Procedure", IEEE Transactions on Communications, vol. COM-29, No. 2, pp. 101-109, 1981.*

Yeldener et al., "Multiband Linear Predictive Speech Coding at Very Low Bit Rates", IEEE Proceedings in Visual Images Siganl Processing, vol. 141, No. 5, pp. 289-296, 1994.*

Yeldener et al., "A 4 kb/s toll quality harmonic excitation linear predictive speech coder", ICASSP-1999, vol. 1, pp. 481-484, 1999.*

* cited by examiner

METHOD AND APPARATUS TO QUANTIZE/DEQUANTIZE FREQUENCY AMPLITUDE DATA AND METHOD AND APPARATUS TO AUDIO ENCODE/DECODE USING THE METHOD AND APPARATUS TO QUANTIZE/DEQUANTIZE FREQUENCY AMPLITUDE DATA

CROSS-REFERENCE TO RELATED APPLICATIONS

This application claims the benefit of Korean Patent Application No. 10-2005-0063304, filed on Jul. 13, 2005, and Korean Patent Application No. 10-2006-0015940, filed on Feb. 18, 2006 in the Korean Intellectual Property Office, the disclosures of which are incorporated herein in their entirety by reference.

BACKGROUND OF THE INVENTION

1. Field of the Invention

The present general inventive concept relates to audio encoding and decoding, and more particularly, to a method and apparatus to quantize/dequantize frequency amplitude data and a method and apparatus to audio encode/decode using the method and apparatus to quantize/dequantize frequency amplitude data.

2. Description of the Related Art

With the diversification of application fields of audio communication and the improvement in transmission speeds of networks, there is a demand for high-quality audio communication. In order to meet this demand, the transmission of a wideband audio signal with a bandwidth of 0.3 kHz-7 kHz, which has superior performance compared to a conventional audio communication bandwidth of 0.3 kHz-3.4 kHz in various aspects, such as spontaneity and articulation, is required.

A packet switching network that transmits data in packet units may cause channel congestion, resulting in packet loss and audio quality degradation. In order to address this problem, a technique for concealing a damaged packet is widely used. However, this technique is not a perfect solution to the problem. Thus, wideband audio signal encoding/decoding techniques capable of effectively compressing a wideband audio signal and solving the channel congestion problem have been proposed.

The techniques that are currently being proposed can be classified as three types of techniques. A first technique compresses audio signals in a 0.3 kHz-7 kHz band at a certain time and restores the compressed audio signals. A second technique divides the audio signals in the 0.3 kHz-7 kHz band into audio signals in a 0.3 kHz-4 kHz band (i.e., a low band) and audio signals in a 4 kHz-7 kHz band (i.e., a high band), hierarchically compresses the audio signals, and restores the compressed audio signals. A third technique compresses audio signals in a 0.3 kHz-3.4 kHz band, restores the compressed audio signals, over-samples the restored audio signals to wideband audio signals in the 0.3 kHz-7 kHz band, obtains a wideband error signal between the wideband audio signals obtained by the over-sampling and the original wideband audio signals, and compresses the wideband error signal.

The second and third techniques are wideband audio encoding/decoding techniques using bandwidth scalability, which allow the optimal communication in a given environment by adjusting the number of levels or the amount of data transmitted from a network to a decoder according to data congestion.

In wideband audio encoding that divides audio signals in the 0.3 kHz-7 kHz band into audio signals in a 0.3 kHz-4 kHz band and audio signals in a 4 kHz-7 kHz band and hierarchically compresses the audio signals, the high-band audio signals in the 4 kHz-7 kHz band are encoded by a modulated lapped transform (MLT). FIG. 1 is a block diagram illustrating a high-band audio encoder using the MLT.

Referring to FIG. 1, in the high-band audio encoder, upon input of a high-band audio signal, an MLT unit 100 performs the MLT on the input high-band audio signal and extracts MLT coefficients. Magnitudes of the extracted MLT coefficients are output to a two-dimensional discrete cosine transform (2D-DCT) unit 110 and signs of the extracted MLT coefficients are output to a sign quantization unit 120.

The 2D-DCT unit 110 extracts 2D-DCT coefficients from the magnitudes of the MLT coefficients and outputs the extracted 2D-DCT coefficients to a DCT coefficient quantization unit 130. The DCT coefficient quantization unit 130 arranges the 2D-DCT coefficients having a 2D structure according to magnitude, the largest statistical magnitude coming first, quantizes the arranged magnitudes (vectors), and outputs codebook indices corresponding to the quantized vectors. The sign quantization unit 120 quantizes and outputs the signs of the MLT coefficients of large magnitudes. The output codebook indices and quantized signs are provided to a high-band audio decoder (not shown), at a decoding end.

However, high-band audio encoding using the MLT has a difficulty in high-quality audio restoration in a low-bitrate audio transmission and undergoes degradation in the performance of audio restoration at low bitrates.

In an attempt to address these problems, a high-band audio encoder using a harmonic coder has been proposed.

FIG. 2 is a block diagram illustrating the high-band audio encoder using the harmonic coder. Referring to FIG. 2, when a high-band audio signal is input, a harmonic peak detection unit 200 detects a harmonic peak of the input high-band audio signal and outputs an amplitude and phase of the high-band audio signal based on the detected harmonic peak.

An amplitude quantization unit 210 quantizes and outputs the amplitude of the input high-band audio signal. A phase quantization unit 220 quantizes and outputs the phase of the input high-band audio signal. The output quantized amplitude and phase are provided to a high-band audio decoder (not shown), at a decoding end.

The high-band audio encoding using the harmonic coder can reproduce a high-quality audio at a low bitrate and with low complexity, however, the high-band audio encoding is limited in supporting bandwidth scalability for the input high-band audio signal.

Wideband error audio encoding compresses audio signals in a 0.3 kHz-3.4 kHz band providing bandwidth scalability, restores the compressed audio signals, over-samples the restored audio signals to wideband audio signals, obtains a wideband error signal between the wideband audio signals obtained by the over-sampling and the original wideband audio signals, and compresses the wideband error signal. In the wideband error audio encoding, the wideband error signals in a 0.05 kHz-7 kHz band are encoded by a modified discrete cosine transform (MDCT). FIG. 3 is a block diagram illustrating a wideband error audio encoder using the MDCT.

Referring to FIG. 3, in the wideband error audio encoder, when a wideband audio signal is input, a down-sampling unit 300 obtains a signal that is down-sampled to a low-band audio signal and a low-band audio encoder 310 encodes the low-band audio signal. The encoded audio signal is restored to a wideband audio signal by an up-sampling unit 320. A subtraction unit 330 subtracts the restored wideband audio signal from the original audio signal (i.e., the input wideband audio signal) to generate a wideband error signal. The generated wideband error signal is input to an MDCT unit 340 where MDCT coefficients of the input wideband error signal are extracted. The extracted MDCT coefficients are split into separate frequency bands by a band splitter 350 and the split MDCT coefficients are normalized by a normalization unit 360. The normalized MDCT coefficients are quantized by a quantization unit 370, and thus codebook indices corresponding to the normalized MDCT coefficients are output. The output codebook indices are provided to a high-band audio decoder (not shown), at a decoding end.

However, the wideband error audio encoding using the MDCT, also has a difficulty in high-quality audio restoration in a low-bitrate audio transmission similar to when the MLT is used.

SUMMARY OF THE INVENTION

The present general inventive concept provides a method and apparatus to quantize/dequantize frequency amplitude data and a method and apparatus to audio encode/decode using the method and apparatus to quantize/dequantize the frequency amplitude data, in which a linear prediction residue of a wideband audio signal is transformed into a frequency domain signal and bandwidth scalability is supported in the quantization of the amplitude of the frequency domain signal for hierarchical encoding/decoding during the encoding/decoding of the wideband audio signal.

Additional aspects of the present general inventive concept will be set forth in part in the description which follows and, in part, will be obvious from the description, or may be learned by practice of the general inventive concept.

The foregoing and/or other aspects of the present general inventive concept are achieved by providing a method of quantizing frequency amplitude data. The method includes calculating and quantizing the power of frequency amplitudes of an audio signal, normalizing the quantized power using frequency amplitude data, and quantizing a first one of even-numbered or odd-numbered data from among the normalized frequency amplitude data.

The method may further include interpolating frequency amplitude data that corresponds to a second one of the even-numbered or odd-numbered frequency amplitude data that is not quantized from among the normalized frequency amplitude data using the quantized first one of the even-numbered or odd-numbered data, and quantizing an interpolation error corresponding to a difference between the second frequency amplitude data that is not quantized and the interpolated frequency amplitude data.

The foregoing and/or other aspects of the present general inventive concept are also achieved by providing a method of quantizing frequency amplitude data. The method includes calculating and quantizing power of frequency amplitudes for each of a plurality of bands that make up an audio frame, normalizing frequency amplitude data for each of the bands using the quantized power, and quantizing a first one of even-numbered or odd-numbered data from among the normalized frequency amplitude data.

The foregoing and/or other aspects of the present general inventive concept are also achieved by providing an audio encoding method including detecting a frequency envelope of a wideband error signal of an audio signal, removing the detected frequency envelope from the wideband error signal to obtain a frequency amplitude and a frequency phase, and encoding the obtained frequency amplitude and frequency phase. The encoding of the frequency amplitude includes calculating and quantizing power of frequency amplitudes for each of a plurality of bands constituting an audio frame, normalizing frequency amplitude data for each of the bands using the quantized power, and quantizing a first one of even-numbered or odd-numbered data from among the normalized frequency amplitude data.

The foregoing and/or other aspects of the present general inventive concept are also achieved by providing an apparatus to quantize frequency amplitude data. The apparatus includes a power calculation unit that calculates power of frequency amplitudes for each of a plurality of bands constituting an audio frame, a power quantization unit that quantizes the calculated power, an amplitude normalization unit that normalizes frequency amplitude data for each of the bands using the quantized power, and a normalized data quantization unit that quantizes a first one of even-numbered or odd-numbered data from among the normalized frequency amplitude data.

The apparatus may further include an interpolation unit that interpolates frequency amplitude data that corresponds to a second one of the even-numbered or odd-numbered frequency amplitude data that is not quantized by the normalized data quantization unit from among the frequency amplitude data normalized by the amplitude normalization unit using quantized first frequency amplitude data from among the normalized frequency amplitude data, and an interpolation error quantization unit that quantizes an interpolation error corresponding to a difference between the second frequency amplitude data that is not quantized and the interpolated frequency amplitude data.

The foregoing and/or other aspects of the present general inventive concept are also achieved by providing an audio encoder including an envelope detection unit that detects a frequency envelope of a wideband error signal of an audio signal, a frequency amplitude/phase obtaining unit that removes the detected frequency envelope from the wideband error signal to obtain a frequency amplitude and a frequency phase, a frequency amplitude encoding unit that encodes the obtained frequency amplitude, and a frequency phase encoding unit that encodes the obtained frequency phase. The frequency amplitude encoding unit includes a power calculation unit that calculates power of frequency amplitudes for each of a plurality of bands making up an audio frame, a power quantization unit that quantizes the calculated power, an amplitude normalization unit that normalizes frequency amplitude data for each of the bands using the quantized power, and a normalized data quantization unit that quantizes a first one of even-numbered or odd-numbered data from among the normalized frequency amplitude data.

The foregoing and/or other aspects of the present general inventive concept are also achieved by providing an encoding apparatus, including an envelope detection unit to detect an envelope of a wideband error signal having at least one frame divided into a first data portion and a second data portion, a frequency amplitude/phase obtaining unit to obtain frequency amplitude data and frequency phase data of the first and second data portions of the wideband error signal based on the detected envelope, and a frequency amplitude encoding unit to interpolate an approximation of the frequency amplitude data of the second data portion from the first data portion, to determine an interpolation error between the frequency amplitude data of the second data portion and the interpolated approximation thereof, and to encode the frequency amplitude data of the first data portion and the determined interpolation error.

The foregoing and/or other aspects of the present general inventive concept are also achieved by providing a method of dequantizing frequency amplitude data. The method includes dequantizing a value (Root Mean Square-RMS index) obtained by quantizing power of frequency amplitudes included in a bitstream to restore the power of the frequency amplitudes, and multiplying impulses corresponding to the number of frequency amplitudes to be restored by the restored power of the frequency amplitudes to restore the frequency amplitudes.

The foregoing and/or other aspects of the present general inventive concept are also achieved by providing a method of dequantizing frequency amplitude data. The method includes dequantizing a value (RMS index) obtained by quantizing power of frequency amplitudes included in a bitstream to restore the power of the frequency amplitudes, dequantizing a quantized first one of even-numbered or odd-numbered normalized frequency amplitude data included in the bitstream to restore the first one of the even-numbered or odd-numbered normalized frequency amplitude data, interpolating the restored normalized first frequency amplitude data to generate frequency amplitude data that corresponds to a second one of the even-numbered or odd-numbered frequency amplitude data that is not restored from among normalized frequency amplitude data, and denormalizing the normalized first frequency amplitude data and the frequency amplitude data generated by the interpolation using the restored power of the frequency amplitudes to restore the frequency amplitude data.

The foregoing and/or other aspects of the present general inventive concept are also achieved by providing a method of dequantizing frequency amplitude data. The method includes dequantizing a value (RMS index) obtained by quantizing power of frequency amplitudes included in a bitstream to restore the power of the frequency amplitudes, dequantizing a quantized first one of even-numbered or odd-numbered normalized frequency amplitude data included in the bitstream to restore the first one of the even-numbered or odd-numbered normalized frequency amplitude data, interpolating the restored normalized first frequency amplitude data to generate frequency amplitude data that corresponds to a second one of the even-numbered or odd-numbered frequency amplitude data that is not restored from among normalized frequency amplitude data, dequantizing quantized interpolation error data included in the bitstream to restore the interpolation error data, and denormalizing the restored first frequency amplitude data, the frequency amplitude data generated by the interpolation, and the restored interpolation error data using the restored power of the frequency amplitudes to restore the frequency amplitude data.

The method may be performed for each of a plurality of bands making up an audio frame that is transformed into a frequency domain.

The foregoing and/or other aspects of the present general inventive concept are also achieved by providing an audio decoding method including restoring a frequency amplitude, restoring a frequency phase, and restoring a frequency envelope of a wideband error signal using the restored frequency amplitude and frequency phase. The restoration of the frequency amplitude includes dequantizing a value (RMS index) obtained by quantizing power of frequency amplitudes included in a bitstream to restore the power of the frequency amplitudes, generating a sequence of impulses corresponding to a number of frequency amplitudes to be restored, and multiplying the generated impulses by the restored power of the frequency amplitudes to restore the frequency amplitudes.

The foregoing and/or other aspects of the present general inventive concept are also achieved by providing an apparatus to dequantize frequency amplitude data. The apparatus includes a frequency power restoration unit that dequantizes a value (RMS index) obtained by quantizing power of frequency amplitudes included in a bitstream to restore the power of the frequency amplitudes, an impulse sequence generation unit that generates a sequence of impulses corresponding to a number of frequency amplitudes to be restored, and a first frequency amplitude restoration unit that multiplies the generated impulses by the restored power of the frequency amplitudes to restore the frequency amplitudes.

The foregoing and/or other aspects of the present general inventive concept are also achieved by providing an apparatus to dequantize frequency amplitude data. The apparatus includes a frequency power restoration unit that dequantizes a value (RMS index) obtained by quantizing power of frequency amplitudes included in a bitstream to restore the power of the frequency amplitudes, a normalized data restoration unit that dequantizes a quantized first one of even-numbered or odd-numbered normalized frequency amplitude data included in the bitstream to restore the first one of the even-numbered or odd-numbered normalized frequency amplitude data, a normalized data interpolation unit that interpolates the restored first normalized frequency amplitude data to generate frequency amplitude data that corresponds to a second one of the even-numbered or odd-numbered frequency amplitude data that is not restored from among normalized frequency amplitude data, and a second frequency amplitude restoration unit that denormalizes the normalized first frequency amplitude data and the frequency amplitude data generated by the interpolation using the restored power of the frequency amplitudes to restore the frequency amplitude data.

The foregoing and/or other aspects of the present general inventive concept are also achieved by providing an apparatus to dequantize frequency amplitude data. The apparatus includes a frequency power restoration unit that dequantizes a value (RMS index) obtained by quantizing power of frequency amplitudes included in a bitstream to restore the power of the frequency amplitudes, a normalized data restoration unit that dequantizes a quantized first one of even-numbered or odd-numbered normalized frequency amplitude data included in the bitstream to restore the first one of the even-numbered or odd-numbered normalized frequency amplitude data, a normalized data interpolation unit that interpolates the restored normalized first frequency amplitude data to generate frequency amplitude data that corresponds to a second one of the even-numbered or odd-numbered frequency amplitude data that is not restored from among normalized frequency amplitude data, an interpolation error restoration unit that dequantizes quantized interpolation error data included in the bitstream to restore the interpolation error data, and a third frequency amplitude restoration unit that denormalizes the first frequency amplitude data restored by the normalized data restoration unit, the frequency amplitude data generated by the normalized data interpolation unit by the interpolation, and the restored interpolation error data restored by the interpolation error restoration unit using the restored power of the frequency amplitudes to restore the frequency amplitude data.

The foregoing and/or other aspects of the present general inventive concept are also achieved by providing an audio decoder including a frequency amplitude restoring unit that restores a frequency amplitude, a frequency phase restoring unit that restores a frequency phase, and a frequency envelope restoring unit that restores a frequency envelope of a wideband error signal using the restored frequency amplitude and frequency phase. The frequency amplitude restoring unit includes a frequency power restoration unit that dequantizes a value (RMS index) obtained by quantizing power of frequency amplitudes included in a bitstream to restore the power of the frequency amplitudes, an impulse sequence generation unit that generates a sequence of impulses corresponding to a number of frequency amplitudes to be restored, and a frequency amplitude restoration unit that multiplies the generated impulses by the restored power of the frequency amplitudes to restore the frequency amplitudes.

The foregoing and/or other aspects of the present general inventive concept are also achieved by providing a dequantizing apparatus, including an even-numbered position dequantizing unit to dequantize a first amplitude vector at an even-numbered position corresponding to even-numbered amplitude indices received in a bitstream, an odd-numbered position interpolation unit to obtain a second amplitude vector at an odd-numbered position based on the dequantized first amplitude vector, an interpolation error dequantization unit to dequantize an interpolation error at an odd-numbered position corresponding to odd-numbered amplitude indices received in the bitstream, and a plurality of interframe interpolation units to perform dequantization at a plurality of scalability levels based on the first and second amplitude vectors and the dequantized interpolation error.

The foregoing and/or other aspects of the present general inventive concept are also achieved by providing a computer-readable recording medium having recorded thereon a program for performing the audio encoding methods and the audio decoding methods (described above).

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
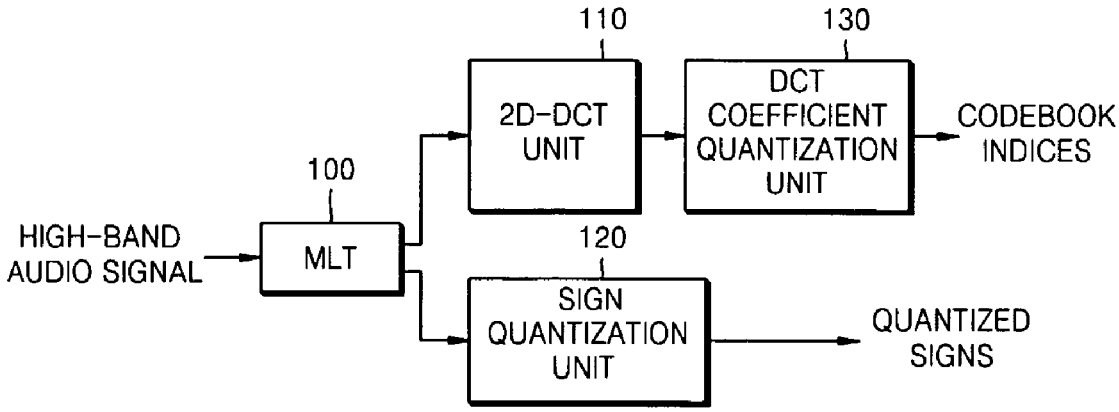
FIG. 1 (PRIOR ART)
FIG. 1 is a block diagram illustrating a high-band audio encoder using a modulated lapped transform (MLT)
Figure 2:
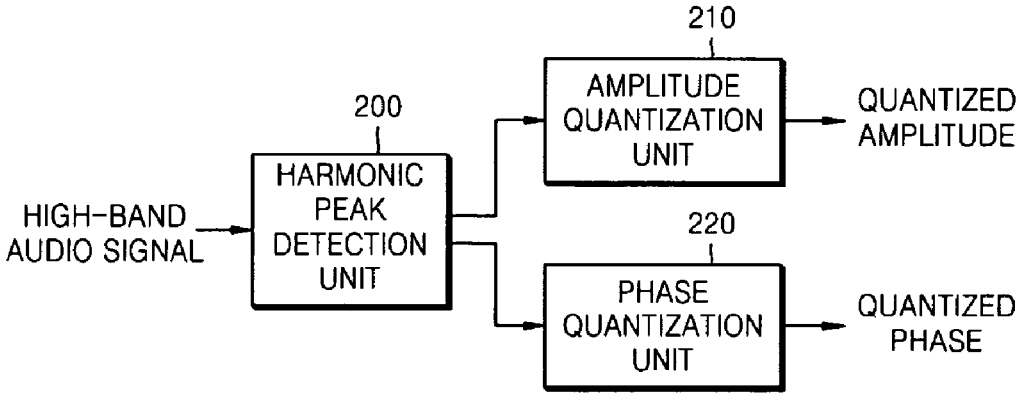
FIG. 2 (PRIOR ART)
FIG. 2 is a block diagram illustrating a high-band audio encoder using a harmonic coder.
Figure 3:
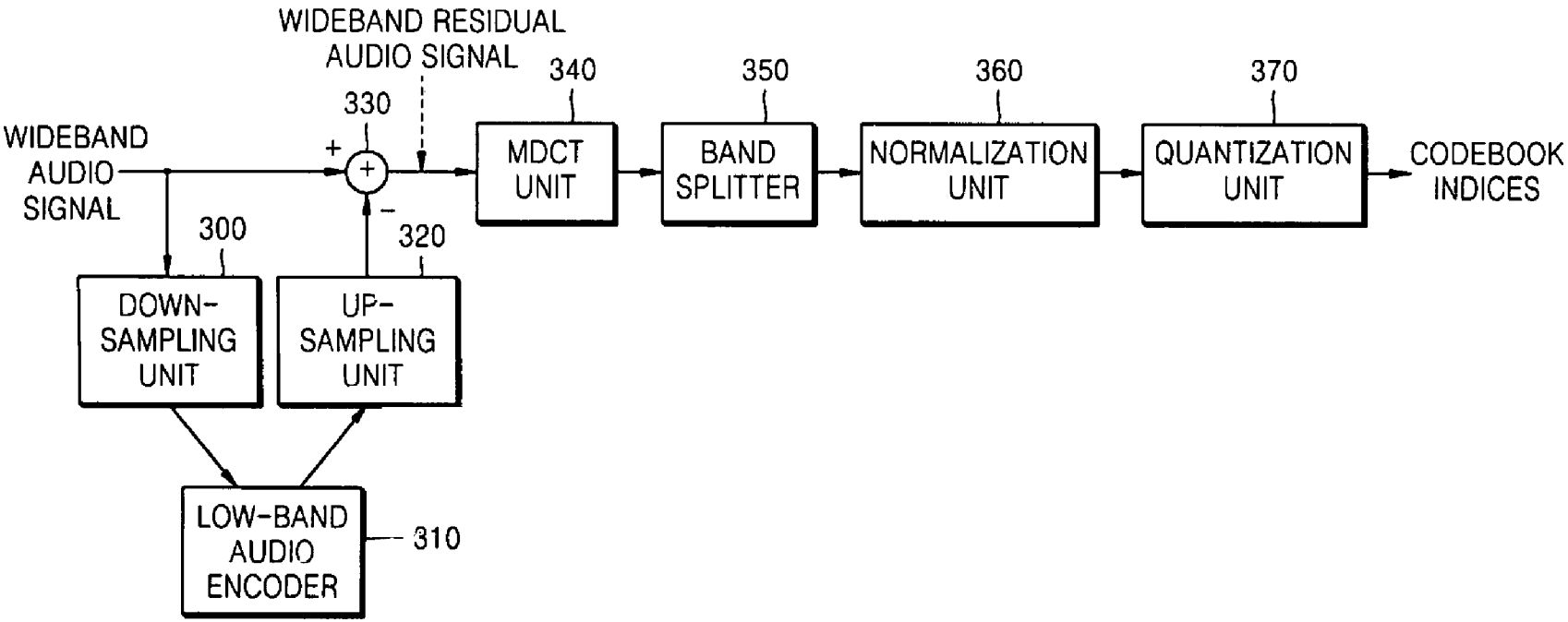
FIG. 3 (PRIOR ART)
FIG. 3 is a block diagram illustrating a wideband error audio encoder using a modified discrete cosine transform (MDCT)

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 4:
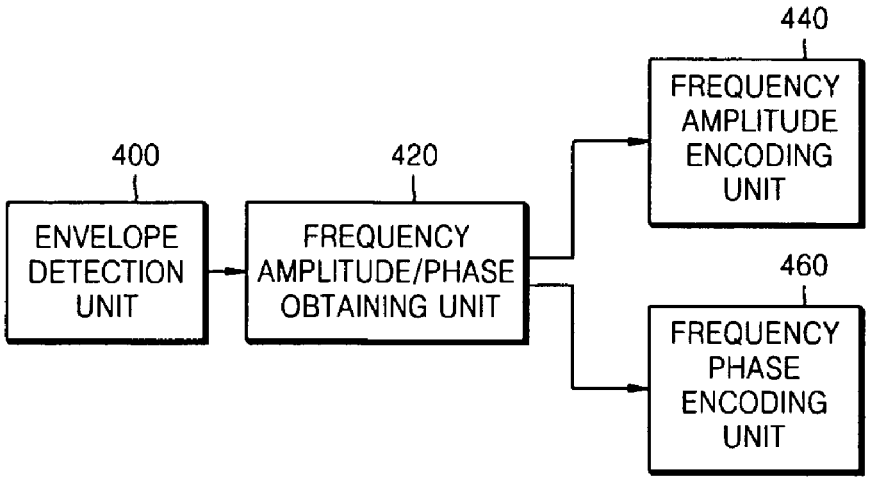
FIG. 4 is a block diagram illustrating an audio encoder having an apparatus to quantize frequency amplitude data according to an embodiment of the present general inventive concept.

FIG. 4 is a block diagram illustrating an audio encoder having an apparatus to quantize frequency amplitude data according to an embodiment of the present general inventive concept. The audio encoder includes an envelope detection unit 400, a frequency amplitude/phase obtaining unit 420, a frequency amplitude encoding unit 440, and a frequency phase encoding unit 460. The envelope detection unit 400 detects a frequency envelope of a wideband error signal of an audio signal.

The frequency amplitude/phase obtaining unit 420 removes the detected frequency envelope from the wideband error signal and obtains a frequency amplitude and a frequency phase. The frequency amplitude encoding unit 440 encodes the obtained frequency amplitude. The frequency phase encoding unit 460 encodes the obtained frequency phase.

Figure 5:
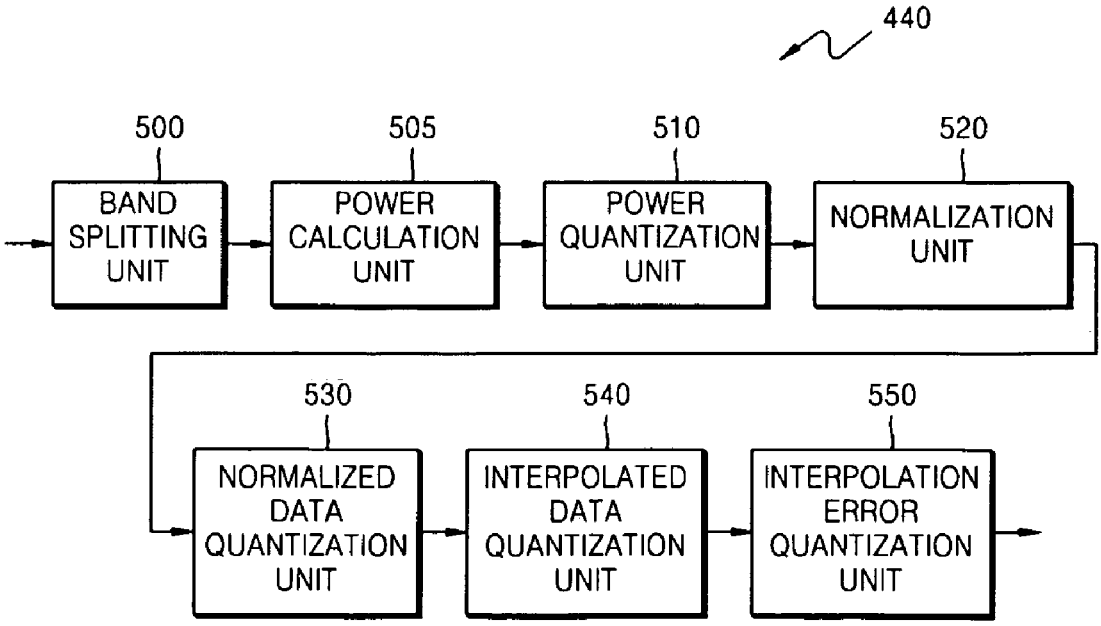
FIG. 5 is a detailed block diagram illustrating a frequency amplitude encoding unit of the audio encoder of FIG. 4.

FIG. 5 is a detailed block diagram illustrating the frequency amplitude encoding unit 440. Referring to FIG. 5, the frequency amplitude encoding unit 440 includes a power calculation unit 505, a power quantization unit 510, a normalization unit 520, a normalized data quantization unit 530, an interpolated data quantization unit 540, and an interpolation error quantization unit 550. The frequency amplitude encoding unit 440 may further include a band splitting unit 500.

The frequency amplitude encoding unit 440 is an example of an apparatus to quantize the frequency amplitude data according to the present embodiment. The apparatus to quantize the frequency amplitude data of the present embodiment includes the power quantization unit 510, the normalization unit 520, and the normalized data quantization unit 530. The apparatus to quantize the frequency amplitude data according to the present embodiment further includes the band splitting unit 500, the interpolated data quantization unit 540, and the interpolation error quantization unit 550.

The band splitting unit 500 splits an audio frame into a plurality of bands.

The power calculation unit 505 calculates power of frequency amplitudes (frequency power) that make up each of the split bands for each of the split bands split by the band splitting unit 500. The power quantization unit 510 quantizes the calculated power for each of the split bands. The normalization unit 520 normalizes frequency amplitude data for each of the split bands using the quantized power. The normalized data quantization unit 530 quantizes even-numbered or odd-numbered data of the normalized frequency amplitude data. The interpolated data quantization unit 540 interpolates frequency amplitude data that is not quantized by the normalized data quantization unit 530 from among all the frequency amplitude data normalized by the normalization unit 520, using the quantized frequency amplitude data, by interpolation. The interpolation error quantization unit 550 calculates an interpolation error corresponding to a difference between the frequency amplitude data that is not quantized from among all the normalized frequency amplitude data and the interpolated frequency amplitude data, and the interpolation error quantization unit 550 quantizes the interpolation error. Here, the even-numbered data may correspond to frequency amplitude data of even numbered sub-frame(s) in a frame of an audio signal, and the odd-numbered data may correspond to frequency amplitude data of odd-numbered sub-frame(s) in the frame of the audio signal. More particularly, the even-numbered data may correspond to frequency amplitude data of bands of the even numbered sub-frame(s) in the frame of the audio signal, and the odd-numbered data may correspond to frequency amplitude data of bands of the odd-numbered sub-frame(s) in the frame of the audio signal.

Figure 6:
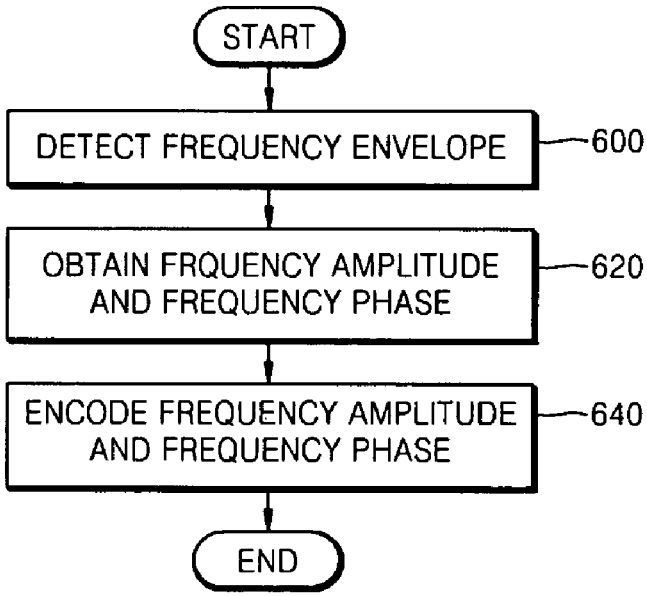
FIG. 6 is a flowchart illustrating an audio encoding method according to an embodiment of the present general inventive concept.

FIG. 6 is a flowchart illustrating an audio encoding method according to an embodiment of the present general inventive concept. Referring to FIG. 6, the frequency envelope of a wideband error signal of an audio signal is detected in operation 600. The detected frequency envelope is removed from the wideband error signal and a frequency amplitude and a frequency phase are obtained in operation 620. The obtained frequency amplitude and frequency phase are encoded in operation 640.

Figure 7:
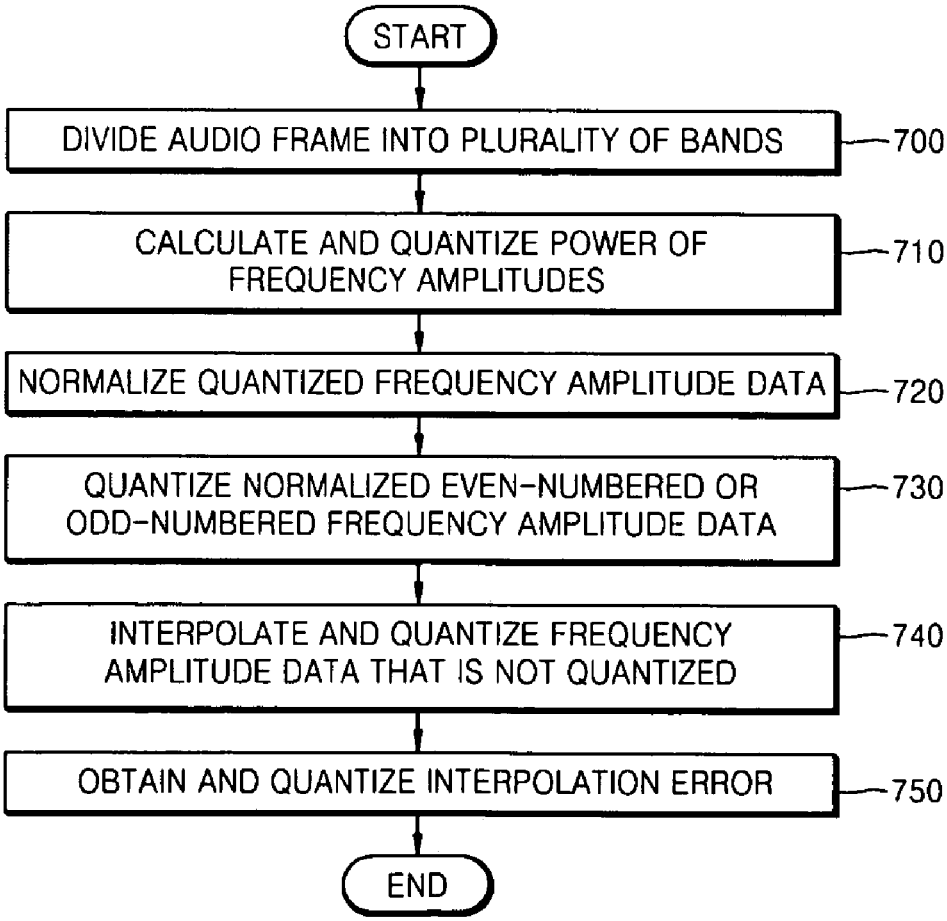
FIG. 7 is a flowchart illustrating a method of quantizing frequency amplitude data in the audio encoding method of FIG. 6.

FIG. 7 is a flowchart illustrating a method of quantizing the frequency amplitude data in the encoding of the frequency amplitude in the operation 640 of the method of FIG. 6. First, a frame of an audio signal transformed into a frequency domain is split into a plurality of bands in operation 700. A power of frequency amplitudes that make up each of the split bands is calculated for each of the split bands, and the power of the frequency amplitude is then quantized in operation 710. Frequency amplitude data is normalized for each of the split bands using the quantized power obtained in operation 720. Even-numbered or odd-numbered data of the normalized frequency amplitude data is quantized in operation 730. In operation 740, the frequency amplitude data that is not quantized in the operation 730 from among all the normalized frequency amplitude data is interpolated using the normalized frequency amplitude data quantized in the operation 730. An interpolation error corresponding to a difference between the frequency amplitude data that is not quantized in the operation 730 from among all the normalized frequency amplitude data and the interpolated frequency amplitude data is obtained, and then the interpolation error is quantized in operation 750. In other words, the operation 750 determines the interpolation error between the interpolated frequency amplitude data and corresponding actual frequency amplitude data.

Figure 8:
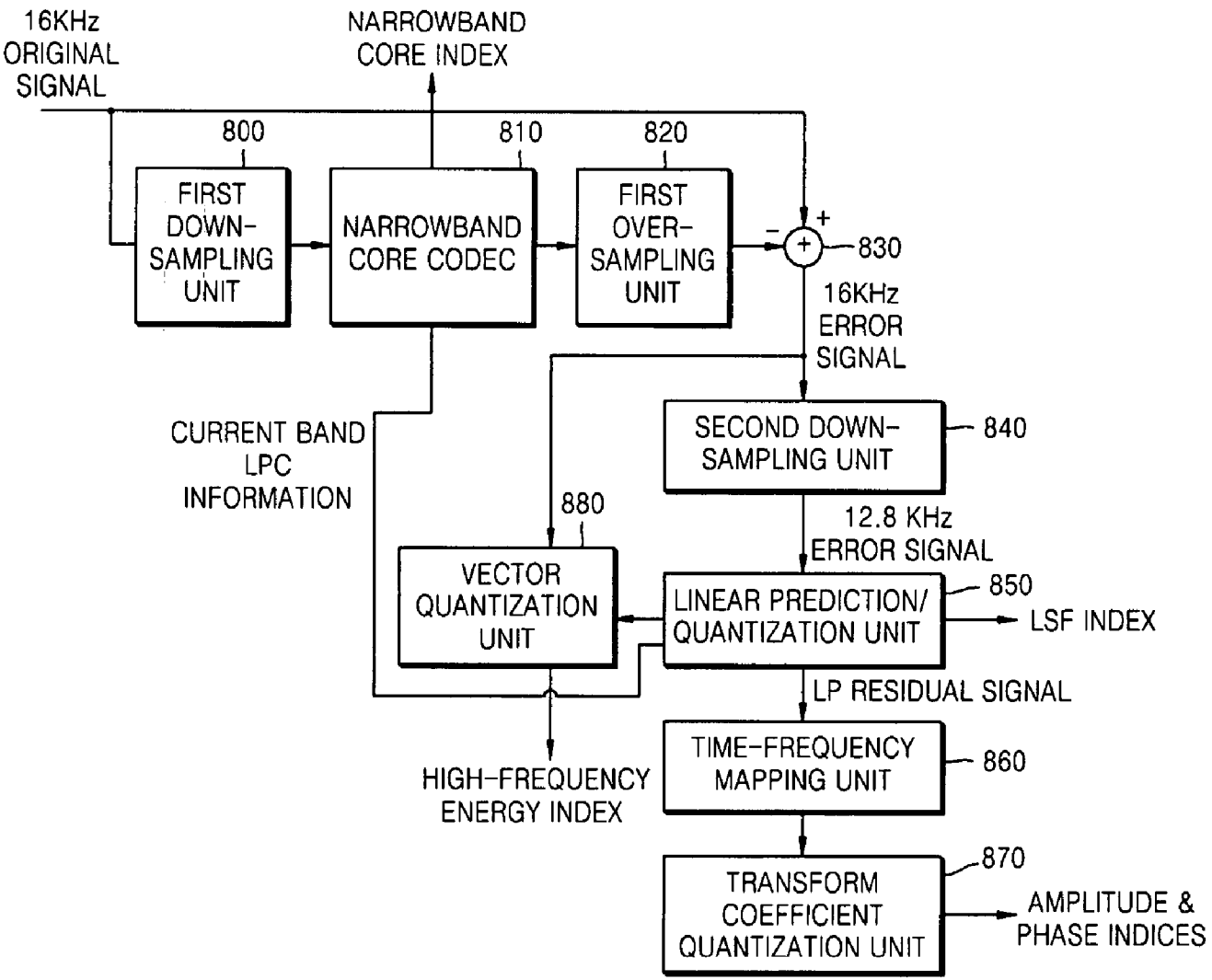
FIG. 8 is a block diagram illustrating an audio encoder according to an embodiment of the present general inventive concept.

FIG. 8 is a block diagram illustrating an audio encoder according to an embodiment of the present general inventive concept. Hereinafter, an operation of the audio encoder will be described with reference to FIG. 8. First, a 16 kHz (wideband) original signal is input to a first down-sampling unit 800, is converted into an 8 kHz signal, and is input to a narrowband core codec 810. The down-sampled original signal is synthesized by the narrowband core codec 810, and the synthesized down-sampled original signal is then converted into the 16 kHz signal by a first over-sampling unit 820. At this time, the 16 kHz signal is synthesized with only a narrow band frequency, and the 16 kHz signal is not synthesized with a high-band frequency. In order to synthesize the 16 kHz signal with a high-band signal and a signal that is not synthesized by the narrowband core codec 810, an error between the 16 kHz wideband original signal and the synthesized 16 kHz signal is extracted by a subtraction unit 830. The extracted 16 kHz error signal is down-sampled to a 12.8 kHz signal by a second down-sampling unit 840. The down-sampled error signal is input to a linear prediction/quantization unit 850. The linear prediction/quantization unit 850 obtains a linear prediction coefficient using an auto-correlation method and a Levinson Durbin algorithm to analyze a frequency envelope of the 12.8 kHz signal. A low-band component of the extracted linear prediction coefficient is replaced with a linear prediction coefficient generated by the narrowband core codec 810 and only a high-band component of the extracted linear prediction coefficient is quantized by a vector quantization unit 880, in order to allow an audio decoder to know (i.e., be able to determine) the linear prediction coefficient. The linear prediction/quantization unit 850 also produces a linear spectral frequency (LSF) index. The vector quantization unit 880 produces a high frequency energy index. The LSF and high frequency energy indices can be used by a decoder, when decoding a bitstream at a decoding end.

When an input sample is processed in frame units during the foregoing process(es), a single frame is divided into two sub-frames and encoding is performed on each of the sub-frames in subsequent processes. A first-numbered sub-frame is defined as a first sub-frame, a second-numbered sub-frame is defined as a second sub-frame, and an $L^{th}$-numbered sub-frame is defined as an $L^{th}$ sub-frame.

The linear prediction of the 12.8 kHz error signal is analyzed using the obtained linear prediction coefficient. When this process is interpreted in the frequency domain, it can have an effect of making the frequency domain flat by removing the frequency envelope of the audio signal. A linear prediction residual signal is generated through linear prediction analysis and quantization, and the linear prediction residual signal is input to a time-frequency mapping unit 860 for transformation into a frequency domain. For frequency transformation, a fast Fourier transform (FFT) may be used in the present embodiment, however, other frequency transforms may also be used with the general inventive concept.

Referring to the FFT in the previous process, when N time domains are frequency-transformed, 2N frequency components in complex forms are output and remaining components except for the $0^{th}$ and $N^{th}$ components exist symmetrically. By processing the $N^{th}$ data that is a Nyquist frequency component as 0, only N complex values from among a total of 2N complex values are encoded to express signs. Band splitting will be described with reference to FIG. 9.

The complex values are quantized by a transform coefficient quantization unit 870. The complex values are quantized separately for the frequency amplitude and the frequency phase. The frequency phase is quantized using various methods such as vector quantization (VQ), scalar quantization (SQ), split VQ (SVQ), multi-stage split VQ (MSVQ) according to constraints, such as transmission rate, memory, and complexity.

Figure 9:
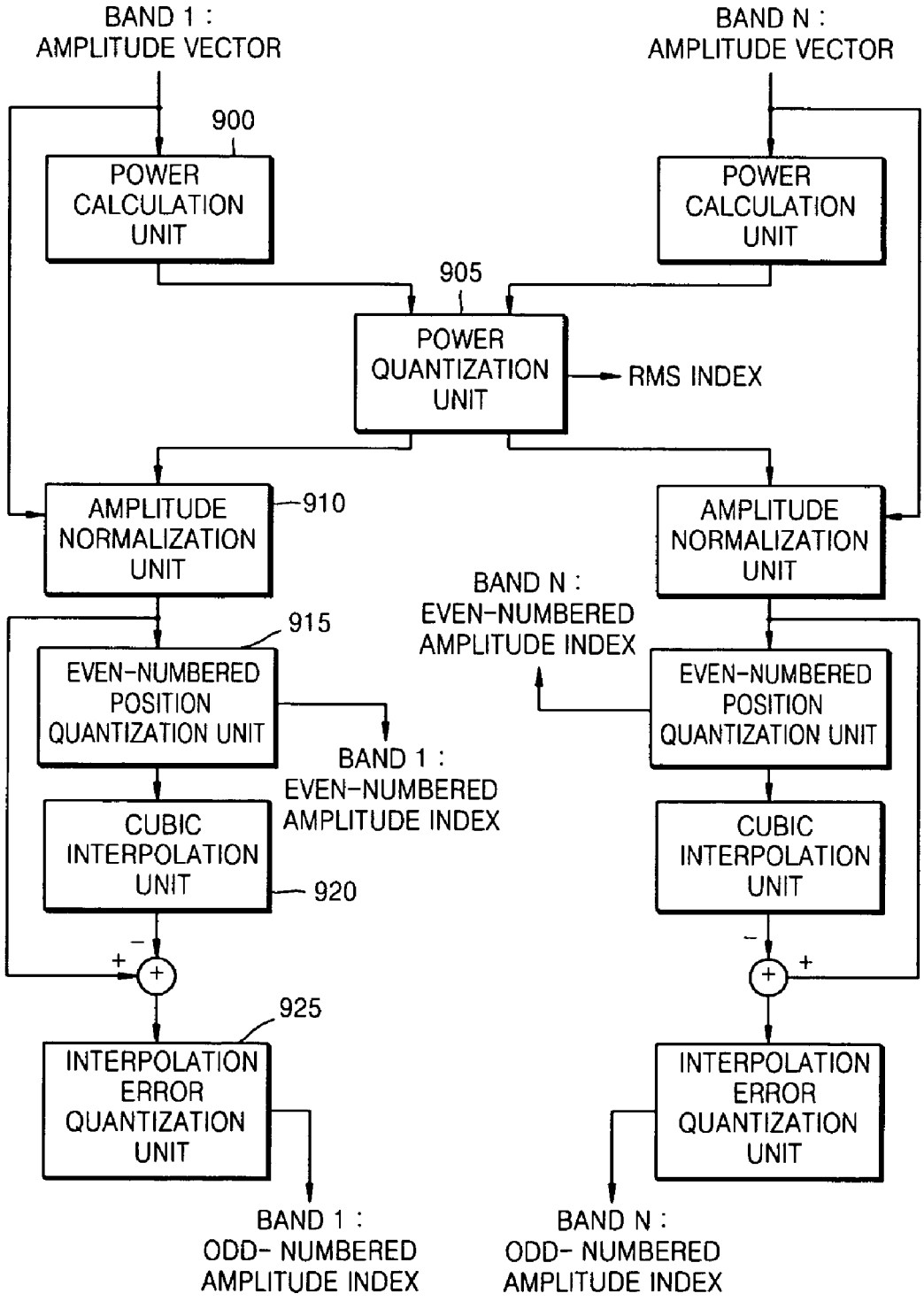
FIG. 9 is a conceptual block diagram illustrating a method of quantizing frequency amplitude data according to an embodiment of the present general inventive concept.

The frequency amplitude is quantized hierarchically as illustrated in FIG. 9. FIG. 9 is a conceptual block diagram illustrating a method of quantizing frequency amplitude data according to an embodiment of the present general inventive concept. Referring to FIG. 9, the frequency amplitude is split into N bands for an even-numbered sub-frame and frequency amplitudes corresponding to each of the split N bands are input to a power calculation unit 900 to calculate a frequency power "p." The frequency power "p" is calculated as follows:

$$p = \frac{1}{e-s+1}\sum_{n=s}^{e} m_n^2, \tag{1}$$

where "s" and "e" indicate a first frequency index and a last frequency index of a band, respectively, and "$m_n$" indicates an $n^{th}$ frequency amplitude in an even-numbered sub-frame. Thus, if the frequency amplitude is split into N bands, N frequency power information pieces are generated and are quantized by a power quantization unit 905. Since the frequency power information pieces for the split bands have strong correlation with one another, the frequency power information pieces for the split bands are grouped as a set of N vectors, and then the N vectors are quantized. When a scalable decoding algorithm is supported, the quantized power information is transmitted to an audio decoder, and an additional gain for each level is typically required to restore accurate energy. However, by using the previous process, a need for the additional gain is removed because a final size is fixed at all times.

The frequency amplitude is normalized by an amplitude normalization unit 910 to obtain the quantized frequency power corresponding to each of the bands. The normalized frequency amplitude vectors are quantized in the same manner. A quantization method for a single band is described as follows. For a frequency amplitude vector corresponding to the single band, an even-numbered frequency amplitude is first quantized by an even position quantization unit 915. For even position quantization, various quantization methods such as VQ, SQ, SVQ, and MSVQ are used according to constraints, such as transmission rate, memory, and complexity.

For compensation, an odd-numbered frequency amplitude is interpolated by a cubic interpolation unit 920 from the quantized even-numbered frequency amplitude, as follows:

$$m_{2n+1} = \frac{m_{2n+2} - m_{2n}}{2} - \frac{m''_{n+1} - m''_n}{4}, \tag{2}$$

where "m" indicates a second differential value of the quantized odd-numbered frequency amplitude and can be expressed as follows:

$$m'_n = m_{2n+2} - m_{2n}$$

$$m''_n = m'_n - m'_{n-1} \tag{3}$$

Since the quantized odd-numbered frequency amplitude is interpolated information, the quantized odd-numbered frequency amplitude may have many errors. In order to improve the accuracy of the quantized odd-numbered frequency amplitude, an interpolation error quantization unit 925 quantizes an interpolation error signal at an odd-numbered position. For odd-numbered position quantization, various quantization methods, such as VQ, SQ, SVQ, and MSVQ as in the even-numbered position quantization may be used according to constraints, such as a transmission rate, a memory, and complexity. The other bands are quantized in the same manner as illustrated in FIG. 9.

Upon completion of quantization of the even-numbered sub-frame, the odd-numbered sub-frame is obtained through interframe interpolation using the quantized even-numbered sub-frame.

For the odd-numbered sub-frame, interpolation, instead of quantization, may be used as follows:

$$m_{n,1} = (m_{n-1,2} + m_{n,2}) \times 0.5 \tag{4}$$

where $m_{n,1}$ indicates an odd-numbered sub-frame in an $n^{th}$ frame, $m_{n-1,2}$ indicates an even-numbered sub-frame in an $(n-1)^{th}$ frame, and $m_{n,2}$ indicates an even-numbered sub-frame in the $n^{th}$ frame.

The frequency amplitude of the quantized even-numbered sub-frame or the interpolated odd-numbered sub-frame is scaled by multiplying the frequency amplitude by the quantized frequency power.

Figure 10:
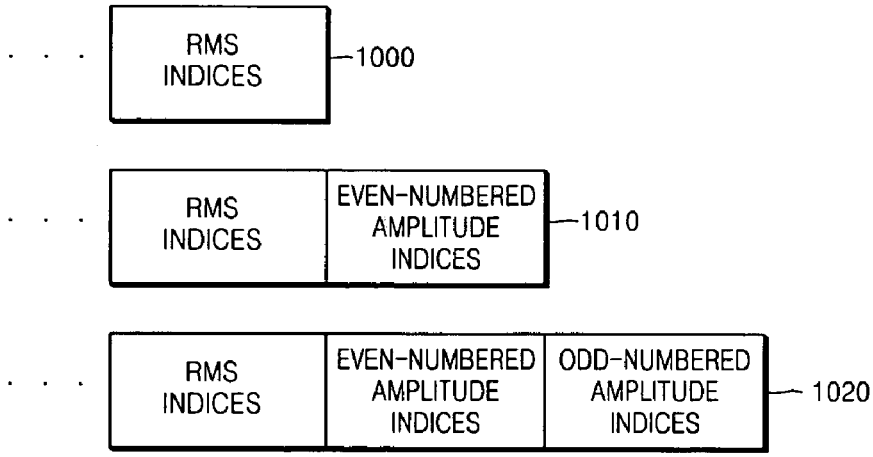
FIG. 10 is a block diagram illustrating a bitstream provided by a method and apparatus to quantize frequency amplitude data according to an embodiment of the present general inventive concept.

FIG. 10 illustrates a bitstream provided by a method and apparatus to quantize frequency amplitude data according to an embodiment of the present general inventive concept. The bitstream is arranged in order of Root Mean Square (RMS) indices, then even-numbered amplitude indices, then odd-numbered amplitude indices. In FIG. 10, reference number 1000 indicates a case in which only the RMS indices are transmitted to an audio decoder, at a decoding end. In this case, the most number of quantization errors occur, but decoding is possible with basic information. Reference number 1010 indicates a case in which the RMS indices and the even-numbered amplitude indices are transmitted. Reference number 1020 indicates a case in which the RMS indices, the even-numbered amplitude indices, and the odd-numbered amplitude indices are transmitted, and, in this case, the least number of quantization errors occur. According to this combination, scalability of audio quality can be supported.

Figure 11:
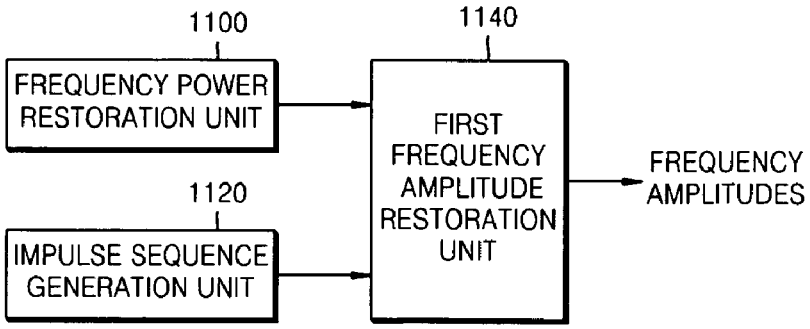
FIG. 11 is a block diagram illustrating an apparatus to dequantize frequency amplitude data according to an embodiment of the present general inventive concept.

FIG. 11 is a block diagram illustrating an apparatus to dequantize frequency amplitude data according to an embodiment of the present general inventive concept. Referring to FIG. 11, the apparatus includes a frequency power restoration unit 1100, an impulse sequence generation unit 1120, and a first frequency amplitude restoration unit 1140.

The frequency power restoration unit 1100 dequantizes a value (an RMS index) obtained by quantizing a power of frequency amplitudes included in a bitstream to restore the power of the frequency amplitudes. The impulse sequence generation unit 1120 generates a sequence of impulses corresponding to a number of frequency amplitudes to be restored. The first frequency amplitude restoration unit 1140 multiplies the impulse sequence by the restored frequency power to restore frequency amplitudes.

Figure 12:
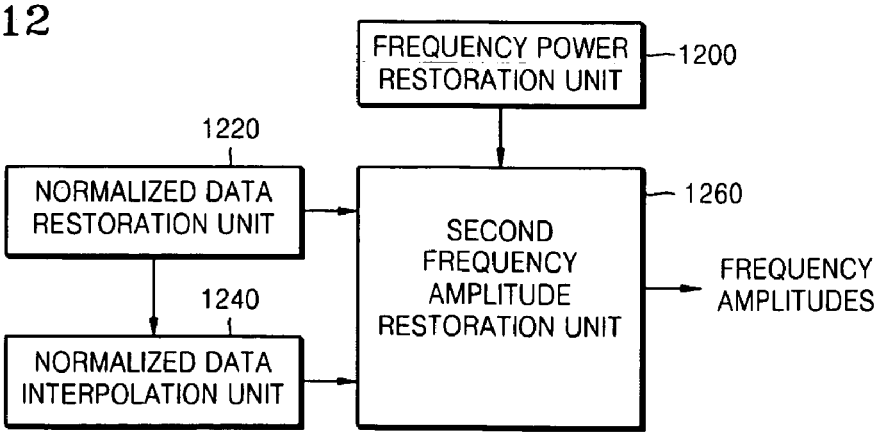
FIG. 12 is a block diagram illustrating an apparatus to dequantize frequency amplitude data according to another embodiment of the present general inventive concept.

FIG. 12 is a block diagram illustrating an apparatus to dequantize frequency amplitude data according to another embodiment of the present general inventive concept. The apparatus includes a frequency power restoration unit 1200, a normalized data restoration unit 1220, a normalized data interpolation unit 1240, and a second frequency amplitude restoration unit 1260.

The frequency power restoration unit 1200 dequantizes a value (an RMS index) obtained by quantizing a power of frequency amplitudes included in a bitstream to restore the power of the frequency amplitudes. The normalized data restoration unit 1220 dequantizes quantized even-numbered or odd-numbered normalized frequency amplitude data included in the bitstream to restore the even-numbered or odd-numbered normalized frequency amplitude data. The normalized data interpolation unit 1240 interpolates the restored normalized frequency amplitude data to generate frequency amplitude data that is not restored by the normalized data restoration unit 1220 from among all the normalized frequency amplitude data. That is, the normalized data interpolation unit 1240 interpolates the other one of the even-numbered or odd-numbered normalized frequency data from the one that is restored by the normalized data restoration unit 1220. The second frequency amplitude restoration unit 1260 denormalizes the normalized frequency amplitude data and the interpolated frequency amplitude data using the restored frequency power, thereby restoring the frequency amplitude data.

Figure 13:
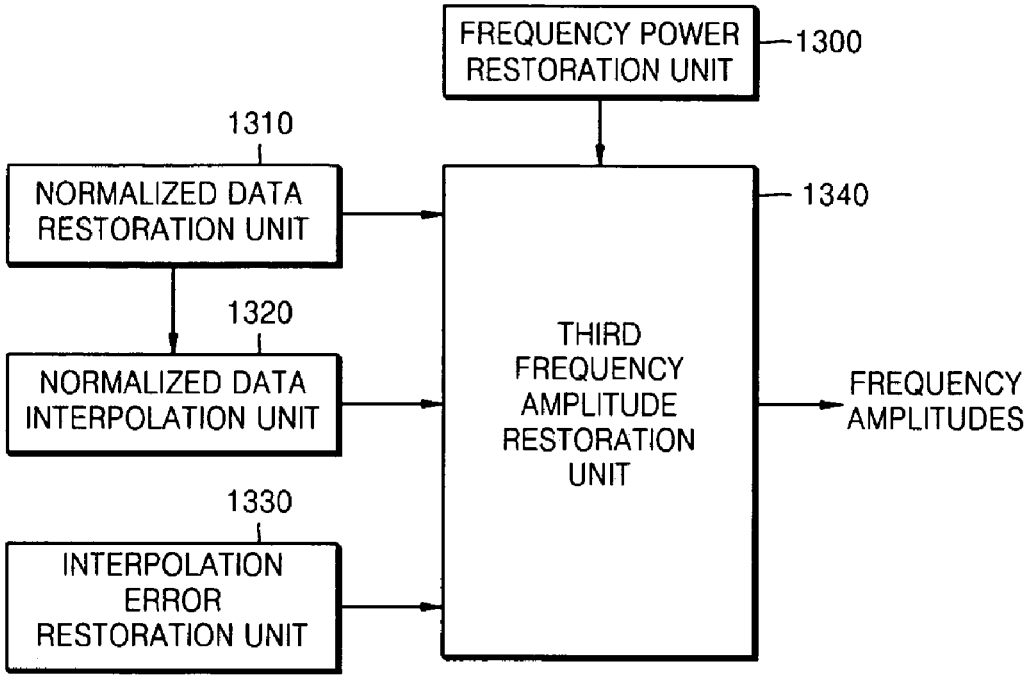
FIG. 13 is a block diagram illustrating an apparatus to dequantize frequency amplitude data according to yet another embodiment of the present general inventive concept.

FIG. 13 is a block diagram illustrating an apparatus to dequantize frequency amplitude data according to yet another embodiment of the present general inventive concept. The apparatus includes a frequency power restoration unit 1300, a normalized data restoration unit 1310, a normalized data interpolation unit 1320, an interpolation error restoration unit 1330, and a third frequency amplitude restoration unit 1340.

The frequency power restoration unit 1300 dequantizes a value (an RMS index) obtained by quantizing a power of frequency amplitudes included in a bitstream to restore the power of the frequency amplitudes. The normalized data restoration unit 1310 dequantizes quantized even-numbered or odd-numbered normalized frequency amplitude data included in the bitstream to restore the even-numbered or odd-numbered normalized frequency amplitude data.

The normalized data interpolation unit 1320 interpolates the restored normalized frequency amplitude data to generate frequency amplitude data that is not restored by the normalized data restoration unit 1310 from among all the normalized frequency amplitude data. That is, the normalized data interpolation unit 1320 interpolates the remaining frequency amplitude data from the normalized frequency amplitude data restored by the normalized data restoration unit 1310. The interpolation error restoration unit 1330 dequantizes quantized interpolation error data included in the bitstream to restore the interpolation error data.

The third frequency amplitude restoration unit 1340 denormalizes the frequency amplitude data restored by the normalized data restoration unit 1310, the frequency amplitude data interpolated by the normalized data interpolation unit 1320, and the interpolation error data restored by the interpolation error restoration unit 1330 using the restored power of the frequency amplitudes restored by the frequency power restoration unit 1300. Accordingly, the third frequency amplitude restoration unit 1340 restores the frequency amplitude data.

Figure 14:
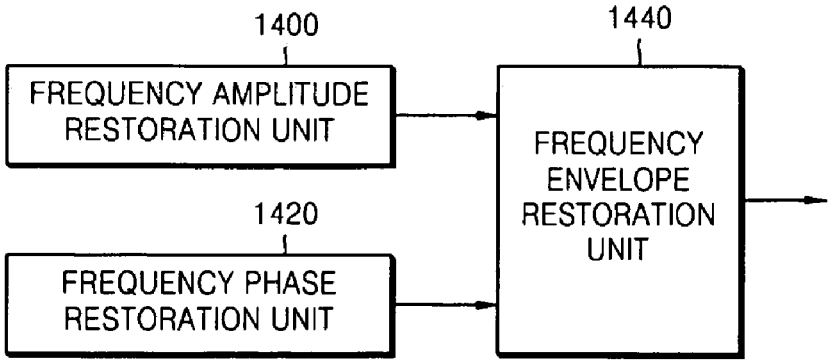
FIG. 14 is a block diagram illustrating an audio decoder having an apparatus to dequantize frequency amplitude data according to an embodiment of the present general inventive concept.

FIG. 14 is a block diagram illustrating an audio decoder having an apparatus to dequantize frequency amplitude data according to an embodiment of the present general inventive concept. The audio decoder includes a frequency amplitude restoration unit 1400, a frequency phase restoration unit 1420, and a frequency envelope restoration unit 1440.

The frequency amplitude restoration unit 1400 restores a frequency amplitude. The frequency phase restoration unit 1420 restores a frequency phase. The frequency envelope restoration unit 1440 restores a frequency envelope of a wideband error signal using the restored frequency amplitude and frequency phase. The frequency amplitude restoration unit 1400 may be the apparatus to dequantize the frequency amplitude data illustrated in FIGS. 12, 13, and/or 14. Since the apparatus to dequantize the frequency amplitude data is described above with reference to FIGS. 12 through 14, a detailed description of the apparatus is not provided here.

Figure 15:
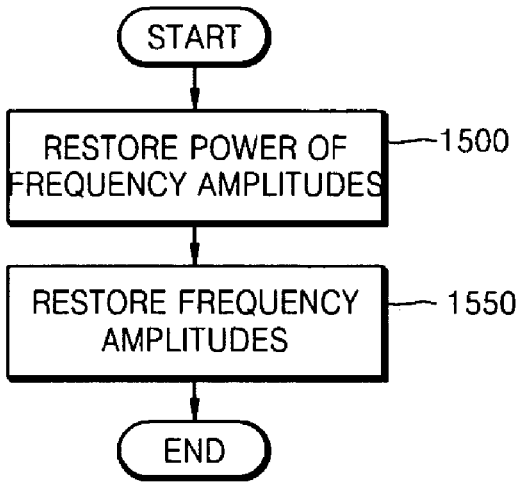
FIG. 15 is a flowchart illustrating a method of dequantizing frequency amplitude data according to an embodiment of the present general inventive concept.

FIG. 15 is a flowchart illustrating a method of dequantizing frequency amplitude data according to an embodiment of the present general inventive concept. In operation 1500, a value (RMS index) obtained by quantizing a power of frequency amplitudes included in a bitstream is dequantized to restore the power of the frequency amplitudes. A sequence of impulses corresponding to a number of frequency amplitudes to be restored is multiplied by the restored power to restore the frequency amplitudes in operation 1550.

Figure 16:
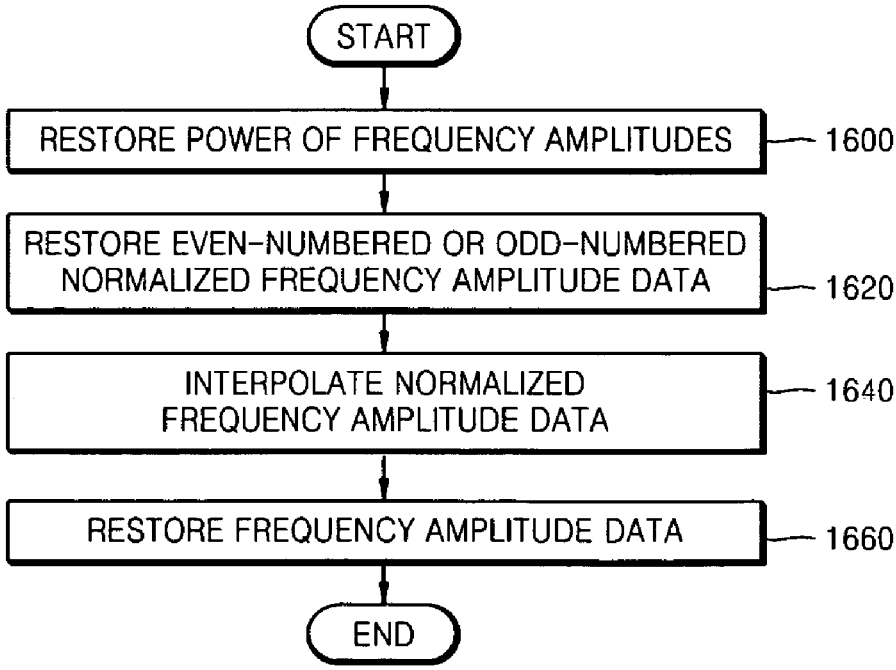
FIG. 16 is a flowchart illustrating a method of dequantizing frequency amplitude data according to another embodiment of the present general inventive concept.

FIG. 16 is a flowchart illustrating a method of dequantizing frequency amplitude data according to another embodiment of the present general inventive concept. First, in operation 1600, a value (RMS index) obtained by quantizing a power of frequency amplitudes included in a bitstream is dequantized to restore the power of the frequency amplitudes. In operation 1620, quantized even-numbered or odd-numbered normalized frequency amplitude data included in the bitstream is dequantized to restore the even-numbered or odd-numbered normalized frequency amplitude data. The restored normalized frequency amplitude data is interpolated to generate frequency amplitude data that is not restored in the operation 1620 from among all the normalized frequency amplitude data in operation 1640. The normalized frequency amplitude data and the interpolated frequency amplitude data are denormalized using the restored power of the frequency amplitudes to restore the frequency amplitude data in operation 1660.

Figure 17:
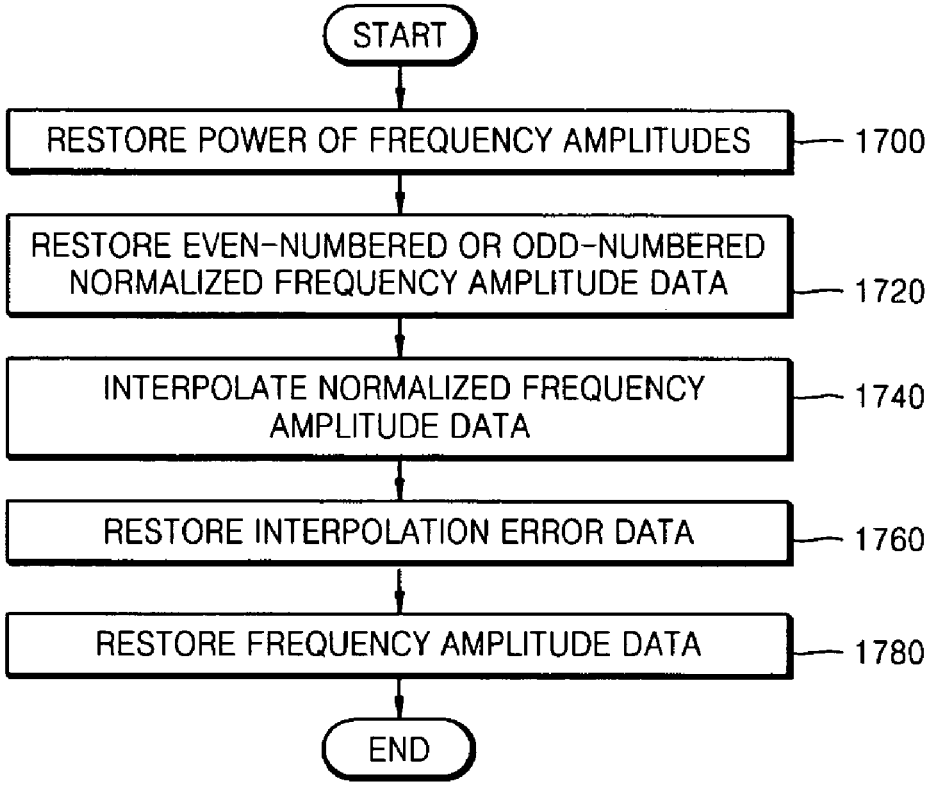
FIG. 17 is a flowchart illustrating a method of dequantizing frequency amplitude data according to yet another embodiment of the present general inventive concept.

FIG. 17 is a flowchart illustrating a method of dequantizing frequency amplitude data according to yet another embodiment of the present general inventive concept. In operation 1700, a value (RMS index) obtained by quantizing a power of frequency amplitudes included in a bitstream is dequantized to restore the power of the frequency amplitudes. In operation 1720, quantized even-numbered or odd-numbered normalized frequency amplitude data included in the bitstream is dequantized to restore the even-numbered or odd-numbered normalized frequency amplitude data. In operation 1740, the restored normalized frequency amplitude data is interpolated to generate frequency amplitude data that is not restored in the operation 1720 from among all the normalized frequency amplitude data. In operation 1760, quantized interpolation error data included in the bitstream is dequantized to restore the interpolation error data. In operation 1780, the restored frequency amplitude data, the interpolated frequency amplitude data, and the restored interpolation error data are denormalized using the restored power of the frequency amplitudes to restore the frequency amplitude data.

Figure 18:
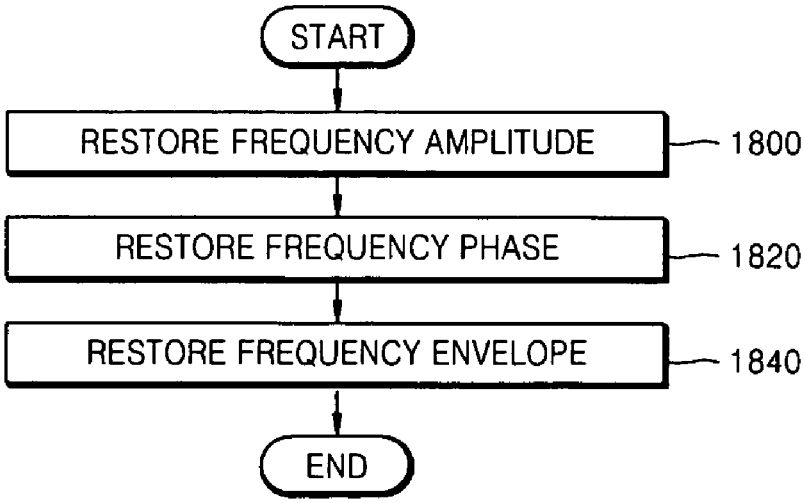
FIG. 18 is a flowchart illustrating an audio decoding method having a method of dequantizing frequency amplitude data according to an embodiment of the present general inventive concept.

FIG. 18 is a flowchart illustrating an audio decoding method according to an embodiment of the present general inventive concept. In operation 1800, a frequency amplitude is restored. In operation 1820, a frequency phase is restored. The operation 1800 of restoring the frequency amplitude may include one of the methods of dequantizing the frequency amplitude data of FIGS. 15, 16, and/or 17. In operation 1840, a frequency envelope of a wideband error signal is restored using the restored frequency amplitude and frequency phase.

Figure 19:
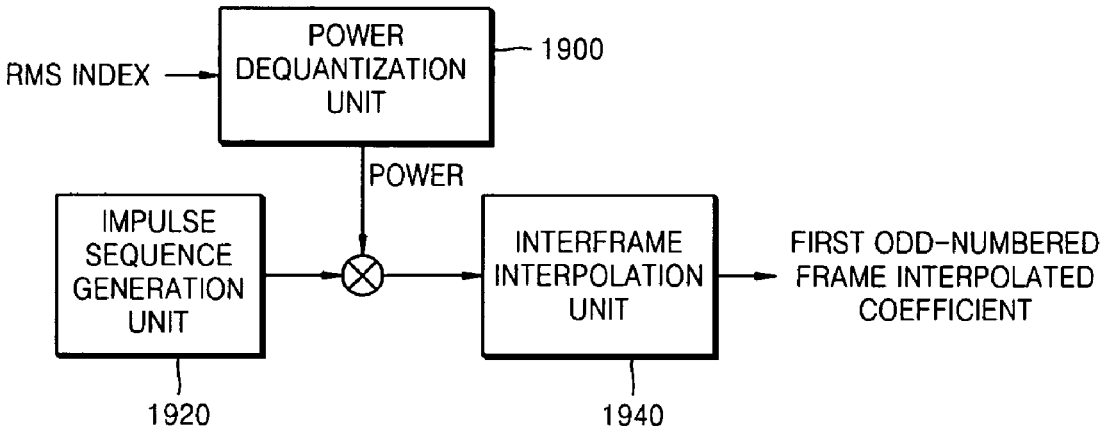
FIG. 19 is a block diagram illustrating an apparatus to dequantize frequency amplitude data according to an embodiment of the present general inventive concept.

FIG. 19 is a block diagram illustrating an apparatus to dequantize frequency amplitude data according to an embodiment of the present general inventive concept. Each band can be dequantized in the same manner as in FIG. 15 to provide bandwidth scalability.

The dequantization of a first level is performed as follows. A power dequantization unit 1900 dequantizes a frequency power of a band corresponding to RMS indices of a transmitted bitstream. An impulse sequence generation unit 1920 generates a sequence of impulses corresponding to a number of frequency amplitudes of the band. The output of the power dequantization unit 1900 and the output of the impulse sequence generation unit 1920 are multiplied to restore an amplitude vector of an even-numbered sub-frame for the first level. In order to obtain amplitude information of a frame between two frames, i.e., an odd-numbered sub-frame for a third level, an interframe interpolation unit 1940 performs interpolation between a last even-numbered sub-frame of a previous frame and an even-numbered sub-frame of a current frame. Interframe interpolation is described above, therefore a detailed description thereof will not be provided here.

Figure 20:
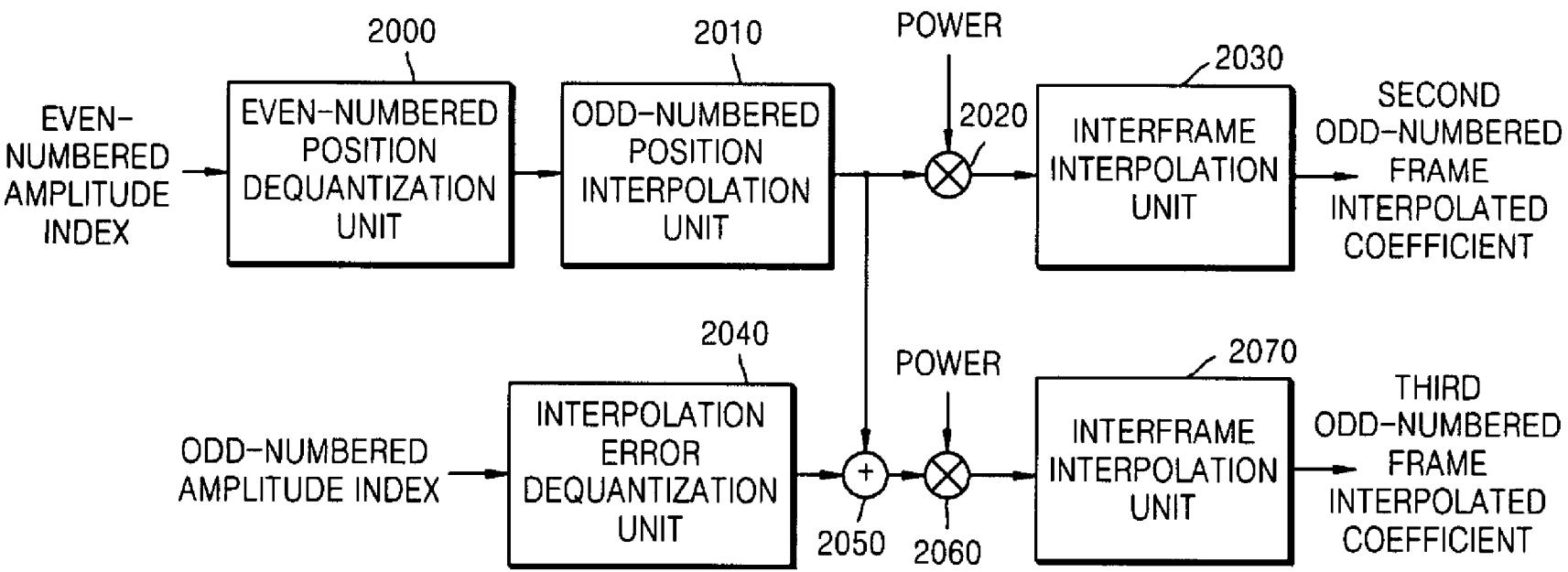
FIG. 20 is a block diagram illustrating an apparatus to dequantize frequency amplitude data according to another embodiment of the present general inventive concept.

FIG. 20 is a block diagram illustrating an apparatus to dequantize frequency amplitude data according to another embodiment of the present general inventive concept. The dequantization of a second level is performed as follows. An even-numbered position dequantization unit 2000 dequantizes an amplitude vector at an even-numbered position corresponding to even-numbered amplitude indices of a transmitted bitstream. An odd-numbered position interpolation unit 2010 obtains an amplitude vector at an odd position from the dequantized amplitude vector at the even-numbered position. A first multiplication unit 2020 multiplies the amplitude vectors by the frequency power to restore an amplitude vector of an even-numbered sub-frame for the second level. In order to obtain amplitude information of a frame between the two frames, i.e., an odd-numbered sub-frame for a third level using the amplitude vector, a first interframe interpolation unit 2030 performs interpolation between a last even-numbered sub-frame of a previous frame and an even-numbered sub-frame of a current frame. Interframe interpolation is described above, therefore a detailed description thereof will not be provided here. Accordingly, the first interframe interpolation unit 2030 outputs a second odd-numbered frame interpolated coefficient.

Next, the dequantization of the third level is performed as follows. An interpolation error dequantization unit 2040 dequantizes an interpolation error at an odd-numbered position corresponding to odd-numbered amplitude indices of the transmitted bitstream. An addition unit 2050 adds the amplitude vectors for the second level with the interpolation error. A second multiplication unit 2060 multiplies the output of the addition unit 2050 by the frequency power to restore an amplitude vector of an even-numbered sub-frame for the third level. In order to obtain amplitude information of a frame between two frames, i.e., an odd-numbered sub-frame for the third level using the amplitude vector, a second interframe interpolation unit 2070 performs interpolation between the last even-numbered sub-frame of the previous frame and the even-numbered sub-frame of the current frame. Interframe interpolation is described above, therefore a detailed description thereof will not be provided here. Accordingly, the second interframe interpolation unit 2070 outputs a third odd-numbered frame interpolated coefficient.

Figure 21:
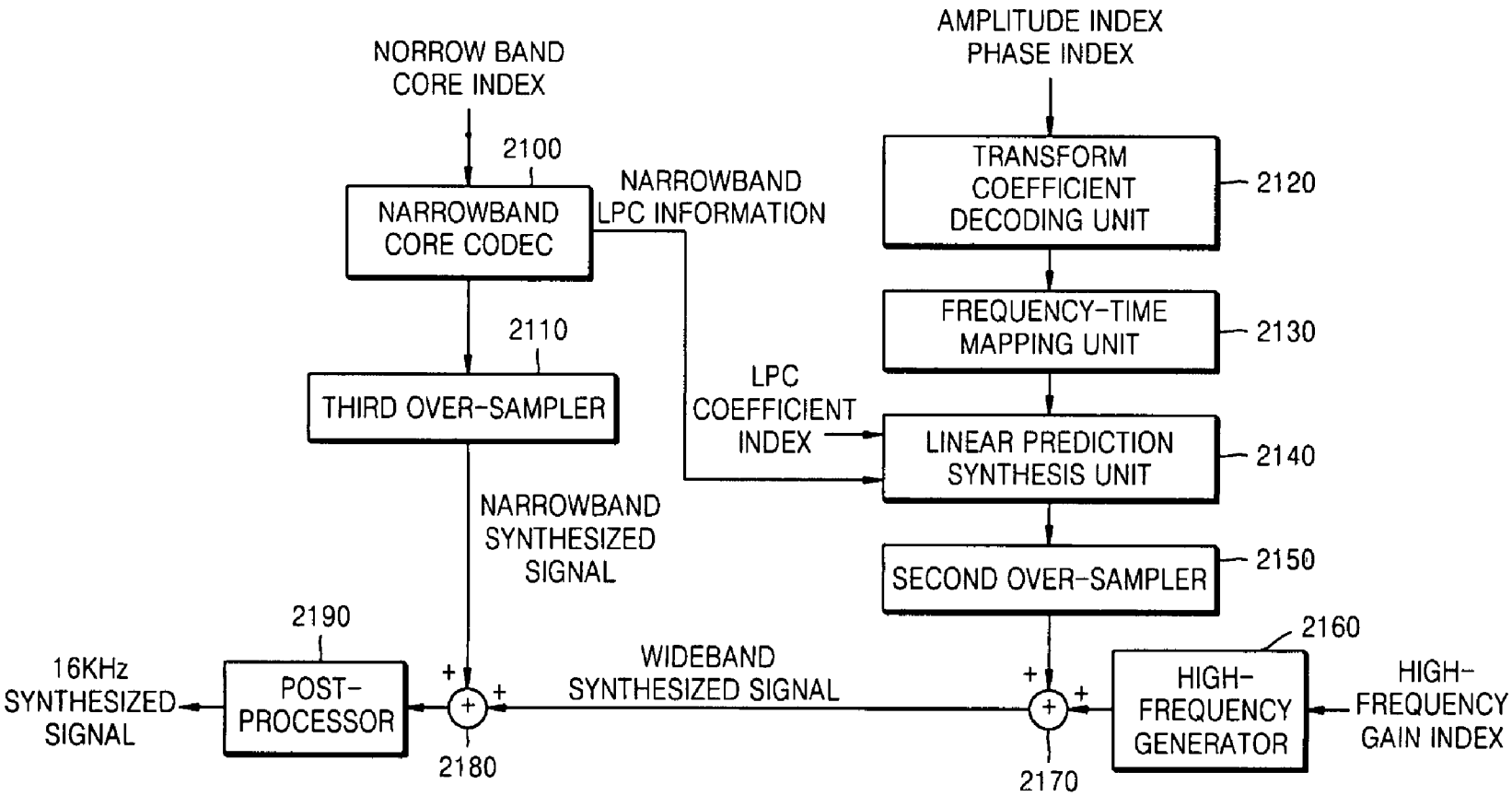
FIG. 21 is a block diagram illustrating an audio decoder according to another embodiment of the present general inventive concept.

FIG. 21 is a block diagram illustrating an audio decoder according to another embodiment of the present general inventive concept. Upon receipt of a bitstream corresponding to an encoded wideband error signal, the received bitstream is depacked for restoration for each level. In other words, if information of only a narrowband core codec that is a part of the bitstream is received, a minimum audio signal, in which only a narrowband signal is restored by a decoder of a narrowband core codec 2100, is restored. At this time, the restored narrowband signal is used to generate a final narrowband signal by a post-processing procedure. If information of a wideband signal is received with the narrowband core codec, a signal corresponding to the received wideband signal information is restored.

For a wideband signal, a previously transmitted amplitude index and phase index are input to a transform coefficient decoding unit 2120 to be transformed into actual coefficients and then into complex forms. Restored frequency information in complex forms is transformed into the time domain by a frequency-time mapping unit 2130. In the present embodiment, an inverse fast Fourier transform (IFFT) may be used for time-domain transformation, however, it should be understood that other time-domain transform methods may alternatively be used along with a frequency transformation method of an audio encoder. A restored linear prediction residual signal can be obtained by the time domain transformation, and the restored linear prediction residual signal is synthesized into an audio signal by a linear prediction synthesis unit 2140 using restored LPC coefficients obtained from LPC coefficient indices. According to the previous process, a 12.8 kHz wideband error signal is restored, and the restored wideband error signal is converted into a 16 kHz wideband error signal by a second over-sampler 2150. At this time, in order to generate a frequency higher than 6.4 kHz in the frequency domain, a high-frequency generator 2160 generates a signal corresponding to a high frequency. The high-frequency generator 2160 generates a virtual 16 kHz signal by performing linear prediction synthesis on a random number generated by a random number generator, extracts only high-frequency components of the generated virtual 16 kHz signal using a high-band pass filter, and multiplies the extracted high-frequency components by a received high-frequency gain, thereby generating a signal higher than 6.4 kHz (i.e., the high frequency signal). If the high-frequency gain is not received through the bitstream, a gain is estimated using the restored linear prediction residual signal and a frequency gradient. Thereafter, the high-frequency signal and the restored 16 kHz wideband error signal are added by a first addition unit 2170 to generate a wideband synthesized signal. The decoder of the narrowband core codec 2100 synthesizes the narrowband audio signal in the same manner as the narrowband decoding described above. The synthesized narrowband audio signal is transformed into a 16 kHz wideband signal by a third over-sampler 2110. The transformed 16 kHz narrowband core audio signal is added to the synthesized wideband signal by a second addition unit 2180 to generate a final synthesized wideband audio signal. The final synthesized wideband audio signal is post-processed by a post-processor 2190 to provide a clearer audio signal. For the post-processing, formant post-processing filtering and gain compensation that are used in a speech codec can be performed. The formant post-processing filtering makes the audio signal more clear by emphasizing formant components of the wideband audio signal and the gain compensation compensates for energy that is lost by the formant post-processing filtering.

As described above, according to embodiments of the present general inventive concept, scalability for a plurality of levels can be supported using frequency amplitude and phase data of a wideband error signal. Moreover, by using the frequency amplitude and phase data of the wideband error signal while maintaining a low-band audio signal, basic audio quality can be secured. Furthermore, with the use of the frequency amplitude data, a wide frequency band can be quantized into a small number of bits and bandwidth scalability can be provided to audio quality.

Additionally, the present general inventive concept may be embodied in a computer readable medium or a software program. For example, a program to perform the method of encoding/decoding a wideband error signal according to embodiments of the present general inventive concept can be embodied as computer-readable code on a computer-readable recording medium. The computer-readable recording medium can be any data storage device that can store data which can be thereafter read by a computer system. Examples of the computer-readable recording medium include read-only memory (ROM), random-access memory (RAM), CD-ROMs, magnetic tapes, floppy disks, and optical data storage devices. The computer readable recording medium can also be distributed over network coupled computer systems so that the computer readable code is stored and executed in a distributed fashion. Also, functional programs, code, and code segments for implementing the present general inventive concept can be easily construed by programmers skilled in the art.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of quantizing frequency amplitude data, the method comprising:

calculating and quantizing power of frequency amplitudes of an audio signal;

normalizing the quantized power using frequency amplitude data;

quantizing a first one of even-numbered or odd-numbered data from among the normalized frequency amplitude;

interpolating frequency amplitude data that corresponds to a second one of the even-numbered or odd-numbered frequency amplitude data that is not quantized from among the normalized frequency amplitude data using the quantized first one of the even-numbered or odd-numbered data; and quantizing an interpolation error corresponding to a difference between the second one of the even-numbered or odd-numbered frequency amplitude data that is not quantized and the interpolated frequency amplitude data.

2. A method of quantizing frequency amplitude data, the method comprising:

calculating and quantizing power of frequency amplitudes for each of a plurality of bands that make up an audio frame;

normalizing frequency amplitude data for each of the bands using the quantized power;

quantizing a first one of even-numbered or odd-numbered data of the normalized frequency amplitude data;

interpolating frequency amplitude data that corresponds to a second one of the even-numbered or odd-numbered frequency amplitude data that is not quantized from among the normalized frequency amplitude data using the quantized first one of the even-numbered or odd-numbered data quantized; and quantizing an interpolation error corresponding to a difference between the second one of the even-numbered or odd-numbered frequency amplitude data that is not quantized and the interpolated frequency amplitude data that is generated by interpolation.

3. An audio encoding method, comprising:

detecting a frequency envelope of a wideband error signal of an audio signal;

removing the detected frequency envelope from the wideband error signal to obtain a frequency amplitude and a frequency phase;

encoding the obtained frequency amplitude and frequency phase, the encoding of the frequency amplitude comprising:

calculating and quantizing power of frequency amplitudes for each of a plurality of bands that make up an audio frame, normalizing frequency amplitude data for each of the bands using the quantized power, and quantizing a first one of even-numbered or odd-numbered data from among the normalized frequency amplitude data;

interpolating frequency amplitude data that corresponds to a second one of the even-numbered or odd-numbered frequency amplitude data that is not quantized from among the normalized frequency amplitude data using the quantized first one of the even-numbered or odd-numbered data; and quantizing an interpolation error corresponding to a difference between the second frequency amplitude data that is not quantized and the interpolated frequency amplitude data.

4. An apparatus to quantize frequency amplitude data, the apparatus comprising:

a power calculation unit to calculate power of frequency amplitudes for each of a plurality of bands making up an audio frame;

a power quantization unit to quantize the calculated power;

an amplitude normalization unit to normalize frequency amplitude data for each of the bands using the quantized power;

a normalized data quantization unit to quantize a first one of even-numbered or odd-numbered data from among the normalized frequency amplitude data;

an interpolation unit to interpolate frequency amplitude data that corresponds to a second one of the even-numbered or the odd-numbered frequency amplitude data that is not quantized by the normalized data quantization unit from among the frequency amplitude data normalized by the amplitude normalization unit using the first quantized frequency amplitude data from among the normalized frequency amplitude data; and an interpolation error quantization unit to quantize an interpolation error corresponding to a difference between the second frequency amplitude data that is not quantized and the interpolated frequency amplitude data.

5. An audio encoder, comprising:

an envelope detection unit to detect a frequency envelope of a wideband error signal of an audio signal;

a frequency amplitude/phase obtaining unit to remove the detected frequency envelope from the wideband error signal to obtain a frequency amplitude and a frequency phase;

a frequency phase encoding unit to encode the obtained frequency phase;

a frequency amplitude encoding unit to encode the obtained frequency amplitude, the frequency amplitude encoding unit comprising:

a power calculation unit to calculate and quantize power of frequency amplitudes for each of a plurality of bands that make up an audio frame, a power quantization unit to quantize the calculated power, an amplitude normalization unit to normalize frequency amplitude data for each of the bands using the quantized power, and a normalized data quantization unit to quantize a first one of even-numbered or odd-numbered data from among the normalized frequency amplitude data;

an interpolation unit to interpolate frequency amplitude data to correspond to a second one of the even-numbered or odd-numbered frequency amplitude data that is not quantized by the normalized data quantization unit from among the frequency amplitude data normalized by the amplitude normalization unit using the quantized first frequency amplitude data from among the normalized frequency amplitude data; and an interpolation error quantization unit to quantize an interpolation error corresponding to a difference between the second frequency amplitude data that is not quantized and the interpolated frequency amplitude data.

6. An encoding apparatus, comprising:

an envelope detection unit to detect an envelope of a wideband error signal having at least one frame divided into a first data portion and a second data portion;

a frequency amplitude/phase obtaining unit to obtain frequency amplitude data and frequency phase data of the first and second data portions of the wideband error signal based on the detected envelope; and a frequency amplitude encoding unit to interpolate an approximation of the frequency amplitude data of the second data portion from the first data portion, to determine an interpolation error between the frequency amplitude data of the second data portion and the interpolated approximation thereof, and to encode the frequency amplitude data of the first data portion and the determined interpolation error.

7. The encoding apparatus of claim 6, wherein the first and second data portions comprise data first and second subframes, respectively, of the at least one frame.

8. The encoding apparatus of claim 6, wherein the first and second data portions comprise data from a first plurality of frequency bands and a second plurality of frequency bands, respectively, of the at least one frame.

9. The encoding apparatus of claim 6, wherein the frequency amplitude encoding unit comprises:

a first quantization unit to quantize the frequency amplitude data of the first data portion; and a second quantization unit to quantize the determined interpolation error.

10. The encoding apparatus of claim 6, wherein the frequency amplitude encoding unit comprises a cubic interpolation unit to interpolate the approximation of frequency amplitude data of the second data portion based on the frequency amplitude data of the first data portion.

11. A method of dequantizing frequency amplitude data, the method comprising:

dequantizing a value (RMS index) obtained by quantizing power of frequency amplitudes included in a bitstream to restore the power of the frequency amplitudes;

dequantizing a quantized first one of even-numbered or odd-numbered normalized frequency amplitude data included in the bitstream to restore the first one of the even-numbered or odd-numbered normalized frequency amplitude data;

interpolating the restored normalized first frequency amplitude data to generate frequency amplitude data that corresponds to a second one of the even-numbered or odd-numbered frequency amplitude data that is not restored from among normalized frequency amplitude data;

dequantizing quantized interpolation error data included in the bitstream to restore the interpolation error data; and denormalizing the restored first frequency amplitude data, the frequency amplitude data generated by the interpolation operation, and the restored interpolation error data using the restored power of the frequency amplitudes to restore the frequency amplitude data.

12. The method of claim 11, wherein the dequantizing of the frequency amplitude data is performed for each of a plurality of bands making up an audio frame that is transformed into a frequency domain.

13. An audio decoding method, comprising:

restoring a frequency amplitude;

restoring a frequency phase;

restoring a frequency envelope of a wideband error signal using the restored frequency amplitude and frequency phase;

wherein the restoring of the frequency amplitude comprises:

dequantizing a value (RMS index) obtained by quantizing power of frequency amplitudes included in a bitstream to restore the power of the frequency amplitudes, generating a sequence of impulses corresponding to a number of frequency amplitudes to be restored, multiplying the generated impulses by the restored power of the frequency amplitudes to restore the frequency amplitudes, and the method further comprises:

dequantizing a quantized first one of even-numbered or odd-numbered normalized frequency amplitude data included in the bitstream to restore the first one of the even-numbered or odd-numbered normalized frequency amplitude data;

interpolating the restored normalized frequency amplitude data to generate frequency amplitude data that corresponds to a second one of the even-numbered or odd-numbered frequency amplitude data that is not restored from among normalized frequency amplitude data;

dequantizing quantized interpolation error data included in the bitstream to restore the interpolation error data; and denormalizing the restored first frequency amplitude data, the frequency amplitude data generated by the interpolation operation, and the restored interpolation error data using the restored power of the frequency amplitudes to restore the frequency amplitude data.

14. An apparatus to dequantize frequency amplitude data, the apparatus comprising:

a frequency power restoration unit to dequantize a value (RMS index) obtained by quantizing power of frequency amplitudes included in a bitstream to restore the power of the frequency amplitudes;

a normalized data restoration unit to dequantize a quantized first one of even-numbered or odd-numbered normalized frequency amplitude data included in the bitstream to restore the first one of the even-numbered or odd-numbered normalized frequency amplitude data;

a normalized data interpolation unit to interpolate the restored normalized first frequency amplitude data to generate frequency amplitude data that corresponds to a second one of the even-numbered or odd-numbered frequency amplitude data that is not restored by the normalized data restoration unit from among normalized frequency amplitude data;

an interpolation error restoration unit to dequantize quantized interpolation error data included in the bitstream to restore the interpolation error data; and a third frequency amplitude restoration unit to denormalize the first frequency amplitude data restored by the normalized data restoration unit, the frequency amplitude data generated by the normalized data interpolation unit by the interpolation, and the interpolation error data restored by the interpolation error restoration unit, using the power of the frequency amplitudes restored by the frequency power restoration unit to restore the frequency amplitude data.

15. The apparatus of claim 14, wherein the frequency power restoration unit, the normalized data restoration unit, the normalized data interpolation unit, the interpolation error restoration unit, and the third frequency amplitude restoration unit operate for each of a plurality of bands making up an audio frame that is transformed into a frequency domain.

16. A dequantizing apparatus, comprising:

an even-numbered position dequantizing unit to dequantize a first amplitude vector at an even-numbered position corresponding to even-numbered amplitude indices received in a bitstream;

an odd-numbered position interpolation unit to obtain a second amplitude vector at an odd-numbered position based on the dequantized first amplitude vector;

an interpolation error dequantization unit to dequantize an interpolation error at an odd-numbered position corresponding to odd-numbered amplitude indices received in the bitstream; and a plurality of interframe interpolation units to perform dequantization at a plurality of scalability levels based on the first and second amplitude vectors and the dequantized interpolation error.

17. An audio decoder, comprising:

a frequency amplitude restoring unit to restore a frequency amplitude;

a frequency phase restoring unit to restore a frequency phase;

a frequency envelope restoring unit to restore a frequency envelope of a wideband error signal using the restored frequency amplitude and frequency phase, wherein the frequency amplitude restoring unit comprises:

a frequency power restoration unit to dequantize a value (RMS index) obtained by quantizing power of frequency amplitudes included in a bitstream to restore the power of the frequency amplitudes, an impulse sequence generation unit to generate a sequence of impulses corresponding to a number of frequency amplitudes to be restored, and a frequency amplitude restoration unit to multiply the generated impulses by the restored power of the frequency amplitudes to restore the frequency amplitudes;

a normalized data restoration unit to dequantize a quantized first one of even-numbered or odd-numbered normalized frequency amplitude data included in the bitstream to restore the first one of the even-numbered or odd-numbered normalized frequency amplitude data;

a normalized data interpolation unit to interpolate the restored normalized first frequency amplitude data to generate frequency amplitude data that corresponds to a second one of the even-numbered or odd-numbered frequency amplitude data that is not restored by the normalized data restoration unit from among normalized frequency amplitude data;

an interpolation error restoration unit to dequantize quantized interpolation error data included in the bitstream to restore the interpolation error data; and a frequency amplitude data restoration unit to denormalize the first frequency amplitude data restored by the normalized data restoration unit, the frequency amplitude data generated by the normalized data interpolation unit by the interpolation, and the interpolation error data restored by the interpolation error restoration unit, using the power of the frequency amplitudes restored by the frequency power restoration unit to restore the frequency amplitude data.

18. A computer-readable recording medium having executable code to perform a method of quantizing frequency amplitude data, the method comprising:

calculating and quantizing power of frequency amplitudes of an audio signal;

normalizing the quantized power using frequency amplitude data;

quantizing a first one of even-numbered or odd-numbered data from among the normalized frequency amplitude;

interpolating frequency amplitude data that corresponds to a second one of the even-numbered or odd-numbered frequency amplitude data that is not quantized from among the normalized frequency amplitude data using the quantized first one of the even-numbered or odd-numbered data; and quantizing an interpolation error corresponding to a difference between the second one of the even-numbered or odd-numbered frequency amplitude data that is not quantized and the interpolated frequency amplitude data.

19. A computer-readable recording medium having executable code to perform a method of quantizing frequency amplitude data, the method comprising:

calculating and quantizing power of frequency amplitudes for each of a plurality of bands that make up an audio frame;

normalizing frequency amplitude data for each of the bands using the quantized power;

quantizing a first one of even-numbered or odd-numbered data of the normalized frequency amplitude data;

interpolating frequency amplitude data that corresponds to a second one of the even-numbered or odd-numbered frequency amplitude data that is not quantized from among the normalized frequency amplitude data using the quantized first one of the even-numbered or odd-numbered data quantized; and quantizing an interpolation error corresponding to a difference between the second one of the even-numbered or odd-numbered frequency amplitude data that is not quantized and the interpolated frequency amplitude data that is generated by interpolation.

20. A computer-readable recording medium having executable code to perform an audio encoding method, comprising:

detecting a frequency envelope of a wideband error signal of an audio signal;

removing the detected frequency envelope from the wideband error signal to obtain a frequency amplitude and a frequency phase;

encoding the obtained frequency amplitude and frequency phase, the encoding of the frequency amplitude comprising:

calculating and quantizing power of frequency amplitudes for each of a plurality of bands that make up an audio frame, normalizing frequency amplitude data for each of the bands using the quantized power, and quantizing a first one of even-numbered or odd-numbered data from among the normalized frequency amplitude data;

interpolating frequency amplitude data that corresponds to a second one of the even-numbered or odd-numbered frequency amplitude data that is not quantized from among the normalized frequency amplitude data using the quantized first one of the even-numbered or odd-numbered data; and quantizing an interpolation error corresponding to a difference between the second frequency amplitude data that is not quantized and the interpolated frequency amplitude data.

21. A computer-readable recording medium having executable code to perform a method of dequantizing frequency amplitude data, the method comprising:

dequantizing a value (RMS index) obtained by quantizing power of frequency amplitudes included in a bitstream to restore the power of the frequency amplitudes;

dequantizing a quantized first one of even-numbered or odd-numbered normalized frequency amplitude data included in the bitstream to restore the first one of even-numbered or odd-numbered normalized frequency amplitude data;

interpolating the restored normalized first frequency amplitude data to generate frequency amplitude data that corresponds to a second one of the even-numbered or odd-numbered frequency amplitude data that is not restored from among normalized frequency amplitude data;

dequantizing quantized interpolation error data included in the bitstream to restore the interpolation error data; and denormalizing the restored first frequency amplitude data, the frequency amplitude data generated by the interpolation operation, and the restored interpolation error data using the restored power of the frequency amplitudes to restore the frequency amplitude data.

22. A computer-readable recording medium having executable code to perform an audio decoding method, comprising:

restoring a frequency amplitude;

restoring a frequency phase;

restoring a frequency envelope of a wideband error signal using the restored frequency amplitude and frequency phase, wherein the restoring of the frequency amplitude comprises:

dequantizing a value (RMS index) obtained by quantizing power of frequency amplitudes included in a bitstream to restore the power of the frequency amplitudes, generating a sequence of impulses corresponding to a number of frequency amplitudes to be restored, multiplying the generated impulses by the restored power of the frequency amplitudes to restore the frequency amplitudes, the method further comprises:

dequantizing a quantized first one of even-numbered or odd-numbered normalized frequency amplitude data included in the bitstream to restore the first one of the even-numbered or odd-numbered normalized frequency amplitude data;

interpolating the restored normalized frequency amplitude data to generate frequency amplitude data that corresponds to a second one of the even-numbered or odd-numbered frequency amplitude data that is not restored from among normalized frequency amplitude data;

dequantizing quantized interpolation error data included in the bitstream to restore the interpolation error data; and denormalizing the restored first frequency amplitude data, the frequency amplitude data generated by the interpolation operation, and the restored interpolation error data using the restored power of the frequency amplitudes to restore the frequency amplitude data.

* * * * *